US005711163A

United States Patent [19]

Uchikawa et al.

[11] Patent Number: 5,711,163

[45] Date of Patent: Jan. 27, 1998

[54] HEAT PUMP APPARATUS

[75] Inventors: Yasuo Uchikawa; Kaoru Hamada, both of Amagasaki, Japan

[73] Assignee: Kubota Corporation, Osaka, Japan

[21] Appl. No.: 680,720

[22] Filed: Jul. 12, 1996

[30] Foreign Application Priority Data

Jul. 14, 1995 [JP] Japan ..... 7-178840

[51] Int. Cl.[6] ..... F25B 1/00

[52] U.S. Cl. ..... 62/324.6; 62/160

[58] Field of Search ..... 62/324.1, 324.6, 62/160

[56] References Cited

U.S. PATENT DOCUMENTS

| | | | |
|---|---|---|---|
| 2,860,491 | 11/1958 | Goldenberg | 62/324.1 |
| 4,514,990 | 5/1985 | Sulkowski | 62/238.7 |
| 5,461,876 | 10/1995 | Dressler | 62/160 |
| 5,473,906 | 12/1995 | Hara et al. | 62/160 |

FOREIGN PATENT DOCUMENTS

| | | | |
|---|---|---|---|
| 162250 | 12/1979 | Japan | 62/324.6 |
| 7-19618 | 7/1993 | Japan . | |

*Primary Examiner*—William Doerrler

*Attorney, Agent, or Firm*—Webb Ziesenheim Bruening Logsdon Orkin & Hanson, P.C.

[57] ABSTRACT

A heat pump apparatus includes a compressor, an expander, at least three heat exchangers and a cooling-medium route switchover device for switching over cooling-medium (refrigerant) route to the heat exchangers so as to selectively provide a two-evaporator operation mode in which two of the heat exchangers are used as evaporators and the other heat exchanger is used as a condenser and a two-condenser operation mode in which two of the heat exchangers are used as condensers and the other heat exchanger is used as an evaporator. The heat exchangers used as evaporators in the two-evaporator operation mode or as condensers in the two-condenser operation mode are serially connected with each other.

10 Claims, 15 Drawing Sheets

HEAT PUMP APPARATUS

BACKGROUND OF THE INVENTION

1. Field of the Invention

The present invention relates to a heat pump apparatus, and more particularly to a compression heat pump having a compressor, an expander means, a plurality of heat exchangers and cooling-medium (refrigerant) route switchover means.

2. Description of the Related Art

In a compression heat pump having a cycle of circulating cooling medium through a compressor, a condenser, an expander means and an evaporator in succession, and then returning the medium to the compressor, in order to enable the pump to provide multiple functions, the convention proposed that the heat pump be provided with three heat exchangers and switchover means for switching over cooling-medium circulation route so as to selectively provide an operation mode using two of the heat exchangers as evaporators and using the other heat exchanger as a condenser and a further operation mode using two of the heat exchangers as condensers and using the other heat exchanger as an evaporator.

In the above-described conventional construction, the two heat exchangers used as evaporators or condensers are connected in parallel with each other. This is intended to achieve a higher operational efficiency through adjustment of amounts of cooling medium circulated through these two heat exchangers depending on the condition of the object or medium to be heat-exchanged ('heat-exchanged' medium, hereinafter) through the two heat exchangers. In the case of the heat exchangers used as evaporators, the heat-exchanged medium comprises medium from which heat is collected, i.e. medium to be cooled. In the case of the heat exchangers used as condensers, the heat-exchanged medium comprises medium to which heat is released or medium to be heated. That is, through the parallel connection, a distribution ratio of the cooling medium between the two heat exchangers is rendered adjustable depending on the condition of the heat-exchanged medium of the respective heat exchangers (see Japanese un-examined patent publication Hei. 7-19618).

However, the adjustment of the cooling-medium distribution ratio between the heat exchangers comprises a quantitative adjustment. Hence, the adjustment construction tends to be complicated in comparison with a simple construction of opening/closing or switching the cooling medium circulation route. Moreover, it is difficult to make proper and accurate adjustment depending on the condition of the heat-exchanged medium of the respective heat exchangers.

In particular, according to the above construction, the apparatus needs to be switchable between the mode of using two heat exchangers as evaporators and the further mode of using the two heat exchangers as condensers. The apparatus also requires the adjustment of cooling-medium distribution ratio in each of the two operation modes. These requirements further complicate the construction of the entire apparatus, thus disadvantageously resulting in increase of manufacture costs and maintenance troubles.

In view of the above-described state of the art, a primary object of the present invention is to provide a heat pump apparatus which does not require complicated adjustments as needed by the conventional apparatus thus not complicating the construction of the entire apparatus and which yet achieves high operational efficiency in accordance with the condition of the heat-exchanged medium of the respective heat exchangers and allows multi-functional use of two-condenser or two-evaporator type apparatus.

A secondary object of the invention is to provide a heat pump apparatus which can minimize such inconvenience as deterioration in the performance of the respective heat exchangers and which can avoid complexity in the control scheme of the apparatus operations and can achieve effectively and reliably improvement of operational efficiency through switchover of circulation order of cooling medium.

SUMMARY OF THE INVENTION

For accomplishing the above-noted objects, a heat pump apparatus, as proposed by the present invention, comprises:

a compressor;

expander means;

at least three heat exchangers; and cooling-medium route switchover means for switching over cooling-medium route to the heat exchangers so as to selectively provide a two-evaporator operation mode in which two of the heat exchangers are used as evaporators and the other heat exchanger is used as a condenser and a two-condenser operation mode in which two of the heat exchangers are used as condensers and the other heat exchanger is used as an evaporator;

wherein said two heat exchangers used as evaporators in said two-evaporator operation mode or as condensers in said two-condenser operation mode are serially connected with each other.

According to the above, in the two-evaporator mode or two-condenser mode, the two heat exchangers are serially connected with each other to allow circulation of the cooling medium (i.e. refrigerant) in series through these heat exchangers. Hence, there is no necessity of the adjustment of cooling-medium distribution ratio between these heat exchangers. Rather, the construction of the invention allows use of simple opening/closing or switching type construction as the cooling-medium route switchover means. So that the circulation order for the two condensers or evaporators may be reversed depending on the condition of the heat-exchanged medium of the respective heat exchangers. In this manner, it has become possible for the apparatus to achieve a higher coefficient of performance and to provide multiple of functions through the selective use of the heat exchangers, without complicating the construction of the entire apparatus.

According to a further aspect of the present invention, the cooling-medium route switchover means allows selection of the two heat exchangers to be used as evaporators in said two-evaporator operation mode and selection of the two heat exchangers to be used as condensers in said two-condenser operation mode.

With this construction too, it is possible to achieve the high apparatus performance through the selection of which heat exchangers to be used as evaporators or condensers, depending on the condition of the heat-exchanged medium thereof and also to provide the two-condenser or two-evaporator type apparatus with multiple of functions.

According to a still further aspect of the invention, the three heat exchangers includes a gas heat exchanger for exchanging heat between the cooling medium and gas, a liquid evaporator heat exchanger for exchanging heat between the cooling medium flowing inside a tube and liquid flowing outside the tube through a wall of the tube, and a liquid condenser heat exchanger for exchanging heat between liquid flowing inside a tube and the cooling medium flowing outside the tube through a wall of the tube. And, the cooling-medium route switchover means selectively provides a first circulation mode for using the gas heat exchanger and the liquid evaporator heat exchanger as evaporators by causing the evaporation cooling medium to circulate through the gas heat exchanger and then the liquid evaporator heat exchanger in series, a second circulation mode for using the liquid evaporator heat exchanger and the gas heat exchanger as evaporators by causing the evaporation cooling medium to circulate through the liquid evaporator heat exchanger and then the gas heat exchanger in series, a third circulation mode for using the gas heat exchanger and the liquid condenser heat exchanger as condensers by causing the condensation cooling medium to circulate through the gas heat exchanger and then the liquid condenser heat exchanger in series, and a fourth circulation mode for using the liquid condenser heat exchanger and the gas heat exchanger as condensers by causing the condensation cooling medium to circulate through the liquid condenser heat exchanger and then the gas heat exchanger in series.

That is, in the case of the two-evaporator operation mode under the first or second circulation mode, as the liquid heat exchanger to be used together with the gas heat exchanger as evaporators by serial circulation of evaporation cooling medium therethrough, there is selected the liquid evaporator heat exchanger (i.e. the one in which the cooling medium is caused to flow inside the tube and the heat-exchange object liquid is caused to flow outside the tube), between the two kinds of liquid heat exchangers, i.e. the liquid evaporator and condenser heat exchangers. With this, in the two-evaporator operation mode, it is possible to avoid such inconveniences as complexity of control of the liquid heat exchanger functioning as one of the evaporators together with the gas heat exchanger, increase in the amount of necessary cooling medium or freezing trouble.

Similarly, in the case of the two-condenser operation mode under the third or fourth circulation mode, as the liquid heat exchanger to be used together with the gas heat exchanger as condensers by serial circulation of condensation cooling medium therethrough, there is selected the liquid condenser heat exchanger (i.e. the one in which the cooling medium is caused to flow outside the tube and the heat-exchange object liquid is caused to flow inside the tube) between the two kinds of liquid heat exchangers, i.e. the liquid evaporator and condenser heat exchangers. With this, in the two-condenser operation mode, it is possible to avoid such inconveniences as deterioration in the condensation performance of the liquid heat exchanger functioning as one of the condensers together with the gas heat exchanger, due to formation of liquid cooling medium layer within this heat exchanger.

As described above, while preventing the inconveniences in the two-evaporator operation mode or in the two-condenser operation mode, selection may be appropriately made, depending on the condition such as the temperature of the heat-exchanged medium, i.e. the gas or liquid, between the first and second circulation modes in the case of the two-evaporator operation mode (i.e. switching over of the order of circulation of evaporation cooling medium between the gas heat exchanger and the liquid evaporator heat exchanger) or between the third and fourth operation modes in the case of the two-condenser operation mode (i.e. switching over of the order of circulation of the condensation cooling medium between the gas heat exchanger and the liquid condenser heat exchanger).

As a result, in the case of the two-evaporator operation mode, it is possible to avoid such inconveniences as complexity of control of the liquid heat exchanger functioning as one of the evaporators together with the gas heat exchanger, increase in the amount of necessary cooling medium or freezing trouble. Similarly, in the case of the two-condenser mode, it is possible to avoid such inconveniences as deterioration in the condensation performance of the liquid heat exchanger functioning as one of the condensers together with the gas heat exchanger, due to formation of liquid cooling medium layer within this heat exchanger.

According to a still further aspect of the present invention, in the first and second circulation modes, the cooling-medium route switchover means circulates the condensation cooling medium to the liquid condenser heat exchanger so as to cause this liquid condenser heat exchanger to act as the condenser.

Further, in the third and fourth circulation mode, the cooling-medium route switchover means circulates the evaporation cooling medium to the liquid evaporator heat exchanger so as to cause this liquid evaporator heat exchanger to act as the evaporator.

As a result, with the above construction, the following effects can be achieved, in addition to the effects achieved by the invention using the first, second, third or fourth circulation modes.

Namely, in the case of the two-evaporator operation mode, the liquid condenser heat exchanger excluded from the heat exchangers to which the evaporation cooling medium is serially circulated is effectively utilized as the other heat exchanger used as the condenser in correspondence with the use of the gas heat exchanger and the liquid evaporator heat exchanger used together as evaporators. Similarly, in the case of the two-condenser operation mode, the liquid evaporator heat exchanger excluded from the heat exchangers to which the condensation cooling medium is serially circulated is effectively utilized as the other heat exchanger used as the evaporator in correspondence with the use of the gas heat exchanger and the liquid condenser heat exchanger used together as condensers. Therefore, in comparison with a further conceivable construction in which an additional heat exchanger is provided as the other heat exchanger, it is possible to reduce the number of heat exchangers for achieving substantially equivalent functions.

Moreover, with the above construction, the liquid condenser heat exchanger constructionally suitable as a condenser may be advantageously used as the single condenser in the two-evaporator operation mode. Also, the liquid evaporator heat exchanger constructionally suitable as an evaporator may be advantageously used as the single evaporator in the two-condenser operation mode. Therefore, this construction can effectively avoid such trouble as the deterioration in the condensation performance due to formation of liquid cooling medium layer within the other heat exchanger in the case of the two-evaporator operation mode or as the complexity of the control, increase in the amount of the necessary cooling medium or freezing trouble in the other heat exchanger in the case of the two-condenser operation mode.

According to a still further aspect of the invention, the apparatus further comprises use mode switchover means for selectively providing a two-heat-collecting source mode for selectively effecting the first and second circulation modes by using the gas heat exchanger and the liquid evaporator heat exchanger as source-side heat exchangers and using the liquid condenser heat exchanger as a load-side heat exchanger and a two-heat-releasing source mode for selectively effecting the third and fourth circulation modes by using the gas heat exchanger and the liquid condenser heat exchanger as source-side heat exchangers and using the liquid evaporator heat exchanger as a load-side heat exchanger.

That is, in the two-heat-collecting source mode, the liquid condenser heat exchanger functioning as a condenser is used for heating liquid for such heating application as heating air or any other substance. Whereas, the gas heat exchanger and the liquid evaporator heat exchanger used as evaporators are used for collecting heat from the gas and liquid heat sources needed for heating by the load-side heat exchanger (i.e. the liquid condenser heat exchanger).

On the other hand, in the two-heat-releasing source mode, the liquid evaporator heat exchanger used as an evaporator is used for cooling liquid for such cooling application as cooling air or any other substance. Whereas, the gas heat exchanger and the liquid condenser heat exchanger are used for releasing exhaust heat generated in association with the cooling by the load-side heat exchanger (i.e. the liquid evaporator heat exchanger) to the gas or liquid heat releasing source.

With the above construction, the following effects can be achieved in addition to the effect achieved by the construction using the first, second, third or fourth circulation modes.

In the two-heat-collecting source mode, the amount of heat needed for the heating at the load-side heat exchanger (i.e. the liquid condenser heat exchanger) is collected by the two kinds of source-side heat exchangers, namely, the gas heat exchanger and the liquid evaporator heat exchanger. Whereas, in the two-heat-releasing source mode, the exhaust heat generated in association with the cooling by the load-side heat exchanger (i.e. the liquid evaporator heat exchanger) is released by the two kinds of heat releasing heat exchangers, i.e. the gas heat exchanger and the liquid condenser heat exchanger. Accordingly, in the respective modes, the load-side heat exchanger may be heated or cooled in a stable manner, regardless of possible variations in the condition of the gas or liquid medium as the heat collecting source in the respective modes.

According to a still further aspect of the invention, in switching over from the two-heat-collecting source mode or the two-heat-releasing source mode, the cooling-medium route switchover means is capable of selectively providing a state in which the gas heat exchanger functions as a source-side heat exchanger functions as an evaporator and a further state in which the gas heat exchanger functions as a condenser, through switchover of the cooling-medium route without switching over the source-side heat exchanger and the load-side heat exchanger.

With the above, in the case of switchover from the two-heat-collecting source mode, the gas heat exchanger and the liquid evaporator heat exchanger are maintained as the source-side heat exchangers and the liquid condenser heat exchanger is maintained as the load-side heat exchanger. Then, by switching over the cooling medium circulation mode from the first or second circulation mode in the two-heat-collecting source mode to the third or fourth circulation mode in the two-condenser operation mode, the heat collecting function of the liquid evaporator heat exchanger as the source-side heat exchanger and the heating function of the liquid condenser heat exchanger as the load-side heat exchanger may be maintained, and at the same time the gas heat exchanger as the other source-side heat exchanger may be utilized for some heating purpose (or heat releasing purpose), which is different from the original heat collecting purpose of the two-heat-collecting source mode.

Similarly, in the case of switchover from the two-heat-releasing source mode, while the gas heat exchanger and the liquid condenser heat exchanger are maintained as the source-side heat exchangers and the liquid evaporator heat exchanger is maintained as the load-side heat exchanger; then, by switching over the cooling medium circulation mode from the third or fourth circulation mode in the two-heat-releasing source mode to the first or second circulation mode in the two-evaporator operation mode, the heat releasing function of the liquid condenser heat exchanger as the source-side heat exchanger and the cooling function of the liquid evaporator heat exchanger as the load-side heat exchanger may be maintained, and at the same time the gas heat exchanger as the other source-side heat exchanger may be utilized for some cooling purpose (or heat collecting purpose), which is different from the original heat releasing purpose of the two-heat-releasing source mode.

As a result, the following effects can be achieved in addition to the effects achieved by the use node switchover means.

In the case of switchover from the two-heat-collecting source mode, while the gas collecting function of the one source-side heat exchanger (i.e. the liquid evaporator heat exchanger) and the heating function of the load-side heat exchanger (i.e. the liquid condenser heat exchanger) are maintained, the other source heat exchanger, i.e. the gas heat exchanger may be used, when necessary, for some heating purpose (or heat releasing purpose) other than the original heat collecting purpose. In this manner, the heat pump apparatus may provide a greater variety of functions.

Incidentally, some specific examples of the heating purpose (or the heat releasing purpose) other than the original heat collecting purpose includes defrosting of the gas heat exchanger which has been frosted during the heat collecting process in the two-heat-collecting source mode, and releasing a portion of the heat collected by the liquid evaporator heat exchanger to the gas heat source by the gas heat exchanger, rather than by the load-side, to the gas heat source side, for the purpose of further reducing the heating capacity of the load-side heat exchanger (i.e. the liquid condenser heat exchanger) when the rate of the revolution of the compressor is lowest.

In the case of switchover from the two-heat-releasing source mode, while the gas releasing function of the one source-side heat exchanger (i.e. the liquid condenser heat exchanger) and the cooling function of the load-side heat exchanger (the liquid evaporator heat exchanger) are maintained, the other source-side heat exchanger, i.e. the gas heat exchanger may be used, when necessary, for some cooling purpose (or heat collecting purpose) other than the original heat releasing collecting purpose. In this manner, the heat pump apparatus may provide a greater variety of functions.

Incidentally, some specific examples of the cooling purpose (or the heat collecting purpose) other than the original heat releasing purpose includes cooling of the gas heat exchanger and/or devices disposed peripherally thereof so as to prevent overheating of these exchanger and devices, and collecting a portion of the heat released by the liquid condenser heat exchanger from the heat source side by the gas heat exchanger rather than the load side, for the purpose of further reducing the cooling capacity of the load-side heat exchanger (i.e. the liquid evaporator heat exchanger) when the rate of the revolution of the compressor is lowest.

According to a still further aspect of the invention, the apparatus further comprises use mode switchover means for selectively providing a two-cooling-load mode for selectively effecting the first and second circulation modes by using the gas heat exchanger and the liquid evaporator heat exchanger as load-side heat exchangers and using the liquid condenser heat exchanger as a source-side heat exchanger and a two-heating-load mode for selectively effecting the third and fourth circulation modes by using the gas heat exchanger and the liquid condenser heat exchanger as load-side heat exchangers and using the liquid evaporator heat exchanger as a source-side heat exchanger.

That is, in the two-cooling-load mode, the gas heat exchanger and the liquid evaporator heat exchanger used as evaporators are utilized for the primary purpose of gas or liquid cooling for cooling air or any other substance. Whereas, the liquid condenser heat exchanger used as a condenser is utilized for releasing, to the liquid heat releasing source, exhaust heat generated in association with the cooling effected by the load-side heat exchangers (i.e. the gas heat exchanger and the liquid evaporator heat exchanger).

On the other hand, in the two-heating-load mode, the gas heat exchanger and the liquid condenser heat exchanger used as condensers are utilized for the primary purpose of gas or liquid heating for heating air or any other substance. Whereas, the liquid evaporator heat exchanger used as an evaporator is utilized for collecting, from the liquid heat collecting source, heat needed for the heating by the load-side heat exchangers (i.e. the gas heat exchanger and the liquid condenser heat exchanger).

With the above construction, the following effects can be achieved in addition to the effect achieved by the cooling-medium switchover means.

In the two-cooling-load mode, two kinds of cooling operations, i.e. the gas cooling operation and the liquid cooling operation, may be effected simultaneously by the two load-side heat exchangers, i.e. the gas heat exchanger and the liquid evaporator heat exchanger. Similarly, in the two-heating-load mode, two kinds of heating operation, i.e. the gas heating operation and the liquid heating operation, may be effected simultaneously by the two load-side heat exchangers, i.e. the gas heat exchanger and the liquid condenser heat exchanger. In these manners, the heat pump apparatus may provide a further variety of functions.

According to a still further aspect of the invention, in switching over from the two-cooling-load mode or the two-heating-load mode, the cooling-medium route switchover means is capable of selectively providing a state in which the gas heat exchanger functions as an evaporator and a further state in which the gas heat exchanger functions as a condenser, through switchover of the cooling-medium route without changing the source-side heat exchanger and the load-side heat exchanger.

With the above construction, in the case of switchover from the two-cooling-load mode, while the gas heat exchanger and the liquid evaporator heat exchanger are maintained as the load-side heat exchangers and the liquid condenser heat exchanger is maintained as the source-side heat exchanger, then by switching over the cooling medium circulation mode from the first or second circulation mode in the two-cooling-load mode to the third or fourth circulation mode in the two-condenser operation mode, the heat releasing function of the liquid condenser heat exchanger as the source-side heat exchanger and the cooling function of the liquid evaporator heat exchanger as the load-side heat exchanger may be maintained and at the same time the gas heat exchanger as the other load-side heat exchanger may be utilized for some heating purpose (or heat releasing purpose), which is different from the original or primary heat collecting purpose of the two-cooling-load mode.

Similarly, in the case of switchover from the two-heating-load mode, while the gas heat exchanger and the liquid evaporator heat exchanger are maintained as the load-side heat exchangers and the liquid evaporator heat exchanger is maintained as the source-side heat exchanger, then by switching over the cooling medium circulation mode from the third or fourth circulation mode in the two-heating-load mode to the first or second circulation mode in the two-evaporator operation mode, the heat collecting function of the liquid evaporator heat exchanger as the source-side heat exchanger and the heat releasing function of the liquid condenser heat exchanger as the load-side heat exchanger may be maintained and at the same time the gas heat exchanger as the other load-side heat exchanger may be utilized for some cooling purpose (or heat collecting purpose), which is different from the original or primary heat releasing purpose of the two-heating-load mode.

As a result, the following effects can be achieved in addition to the effects achieved by the use mode switchover means.

In the case of switchover from the two-cooling-load mode, while the heat releasing function of the source-side heat exchanger (i.e. the liquid condenser heat exchanger) and the cooling function of the one load-side heat exchanger (the liquid evaporator heat exchanger) are maintained, the other load-side heat exchanger, i.e. gas heat exchanger may be used, when necessary, for some heating purpose (or heat releasing purpose) other than the original heat collecting purpose. In this manner, the heat pump apparatus may provide a greater variety of functions.

Incidentally, one specific example of the above-described heating (or heat releasing) purpose other than the primary cooling purpose is as follows. Supposing the gas heat exchanger and the liquid evaporator heat exchanger are used for cooling of respective air-conditioning target areas in the two-cooling-load mode, then, if the air-conditioning load at the air-conditioning target area of the gas heat exchanger alone is now switched over from cooling load to heating load, the operation mode of the gas heat exchanger has to be switched over from the cooling purpose to the heating purpose accordingly. In such case, such heating operation becomes necessary.

In the case of switchover from the two-heating-load mode, while the heat collecting function of the source-side heat exchanger (i.e. the liquid evaporator heat exchanger) and the heating function of the one load-side heat exchanger (the liquid condenser heat exchanger) are maintained, the other load-side heat exchanger, i.e. gas heat exchanger may be used, when necessary, for some cooling purpose (or heat collecting purpose) other than the original heat releasing purpose. In this manner, the heat pump apparatus may provide a greater variety of functions.

Incidentally, one specific example of the above-described cooling (or heat collecting) purpose other than the primary heating purpose is as follows. Supposing the gas heat exchanger and the liquid condenser heat exchanger are used for heating of respective air-conditioning target areas in the two-heating-load mode, then, if the air-conditioning load at the air-conditioning target area of the gas heat exchanger alone is now switched over from heating load to cooling load, the operation mode of the gas heat exchanger has to be switched over from the heating purpose to the cooling purpose accordingly. In such case, such cooling operation becomes necessary.

According to a still further aspect of the present invention, the first through fourth circulation modes are selectively effected by using the liquid evaporator heat exchanger and the liquid condenser heat exchanger as the load-side heat exchangers and using the gas heat exchanger as the source-side heat exchanger.

With the above, the two-evaporator operation mode under the first or second circulation mode will be effected by using the liquid evaporator heat exchanger and the liquid condenser heat exchanger as the load-side heat exchangers and using the gas heat exchanger as the source-side heat exchanger. In this case, the liquid condenser heat exchanger used as a condenser is utilized for heating liquid for the original heating purpose of heating air or any other substance and the liquid evaporator heat exchanger used as an evaporator is utilized for the original cooling purpose of cooling air or any other substance. And, at the same time, the gas heat exchanger used as a further evaporator is utilized for collecting, from the gas heat collecting source, an amount of heat corresponding to a difference between the amount of heat needed for heating by the heating load-side heat exchanger (i.e. the liquid condenser heat exchanger) and the amount of exhaust heat generated in association with the cooling by the cooling load-side heat exchanger (i.e. the liquid evaporator heat exchanger). That is to say, the gas heat exchanger collects from the gas heat collecting source an amount of heat which is deficient in the heat amount needed for the heating operation after being partially compensated for by the collection of the exhaust heat generated in association with the cooling operation.

Also, the two-condenser operation mode under the third or fourth circulation mode will be effected by using the liquid evaporator heat exchanger and the liquid condenser heat exchanger as the load-side heat exchangers and using the gas heat exchanger as the source-side heat exchanger. In this case, the liquid condenser heat exchanger used as a condenser is utilized for heating liquid for the original heating purpose of heating air or any other substance and the liquid evaporator heat exchanger used as an evaporator is utilized for the original cooling purpose of cooling air or any other substance. And, at the same time, the gas heat exchanger used as a further condenser is utilized for releasing, to the gas heat releasing source, an amount of heat corresponding to a difference between the amount of the exhaust heat generated in association with the cooling by the cooling load-side heat exchanger (i.e. the liquid evaporator heat exchanger) and the amount of heat needed for the heating of the heating load-side heat exchanger (i.e. the liquid condenser heat exchanger). That is to say, the gas heat exchanger releases, to the gas heat releasing source, an amount of heat which is left as surplus when a part of the amount of exhaust heat generated in association with the cooling by the cooling load-side heat exchanger is collected and then deducted from the amount of heat needed for the heating of the heating load-side heat exchanger.

According to the above construction, the following effects can be achieved in addition to the effects achieved by the cooling medium switchover means.

The liquid heating operation and the liquid cooling operation may be effected simultaneously by using the liquid condenser heat exchanger (for heating) and the liquid evaporator heat exchanger (for cooling) as the load-side heat exchangers. Further, as the exhaust heat generated in association with the cooling operation by the one load-side heat exchanger is collected and utilized in the heat needed for the heating operation by the other load-side heat exchanger, a further energy saving effect may be achieved in addition to the good performance coefficient described hereinbefore.

According to a still further aspect of the present invention, the cooling-medium route switchover means selectively provides, in addition to the first through fourth circulation modes, a fifth circulation mode in which the evaporation cooling medium is circulated only to the gas heat exchanger while being not circulated to the liquid evaporator heat exchanger, a sixth circulation mode in which the evaporation cooling medium is circulated only to the liquid evaporator heat exchanger while being not circulated to the gas heat exchanger, a seventh circulation mode in which the condensation cooling medium is circulated only to the gas exchanger while being not circulated to the liquid condenser heat exchanger, and an eighth circulation mode in which the condensation cooling medium is circulated only to the liquid condenser heat exchanger while being not circulated to the gas heat exchanger.

With the above construction, in comparison with the case in which both the gas heat exchanger and the liquid evaporator heat exchanger are operated as evaporators in the two-evaporator operation mode under the first or second circulation mode, a higher coefficient of performance may sometimes be achieved by operating either one of the gas heat exchanger and the liquid evaporator heat exchanger, depending on the temperature condition of the gas or liquid subjected to the heat exchange operation. Then, in such case, the above construction provides the possibility of switchover to the fifth circulation mode (i.e. the mode in which the evaporation cooling medium is circulated only to the gas heat exchanger while being not circulated to the liquid evaporator heat exchanger, so that the gas heat exchanger alone acts as an evaporator) or to the sixth circulation mode (i.e. the mode in which the evaporation cooling medium is circulated only to the liquid evaporator heat exchanger while being not circulated to the gas heat exchanger, so that the liquid evaporator heat exchanger alone acts as an evaporator).

Similarly, in comparison with the further case in which both the gas heat exchanger and the liquid condenser heat exchanger are operated as condensers in the two-condenser operation mode under the third or fourth circulation mode, a higher coefficient of performance may sometimes be achieved by operating either one of the gas heat exchanger and the liquid condenser heat exchanger, depending on the temperature condition of the gas or liquid subjected to the heat exchange operation. Then, in such case, the above construction provides the possibility of switchover to the seventh circulation mode (i.e. the mode in which the condensation cooling medium is circulated only to the gas heat exchanger while being not circulated to the liquid condenser heat exchanger, so that the gas heat exchanger alone acts as a condenser) or to the eighth circulation mode (i.e. the mode in which the condensation cooling medium is circulated only to the liquid condenser heat exchanger while being not circulated to the gas heat exchanger, so that the liquid condenser heat exchanger alone acts as a condenser).

As a result, the further effects as follow may be achieved.

In comparison with the case in which both the gas heat exchanger and the liquid evaporator heat exchanger are operated as evaporators in the two-evaporator operation mode, a higher coefficient of performance may be achieved by operating only one of the gas heat exchanger or the liquid evaporator heat exchanger as an evaporator. In this respect, the above construction is capable of selectively providing the state in which only the gas heat exchanger is operated as an evaporator and the further state in which only the liquid evaporator heat exchanger is operated as an evaporator. Similarly, in comparison with the case in which both the gas heat exchanger and the liquid condenser heat exchanger are operated as condensers in the two-condenser operation mode, a higher coefficient of performance may be achieved by operating only one of the gas heat exchanger or the liquid condenser heat exchanger as a condenser. In this respect, the above construction is capable of selectively providing the state in which only the gas heat exchanger is operated as a condenser and the further state in which only the liquid condenser heat exchanger is operated as a condenser. Consequently, in addition to the improvement of the coefficient of performance by the switchover of the circulation order, the performance coefficient may be further improved.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of a heat pump apparatus relating to the present invention will now be described in details with reference to the accompanying drawings.

Figure 1:
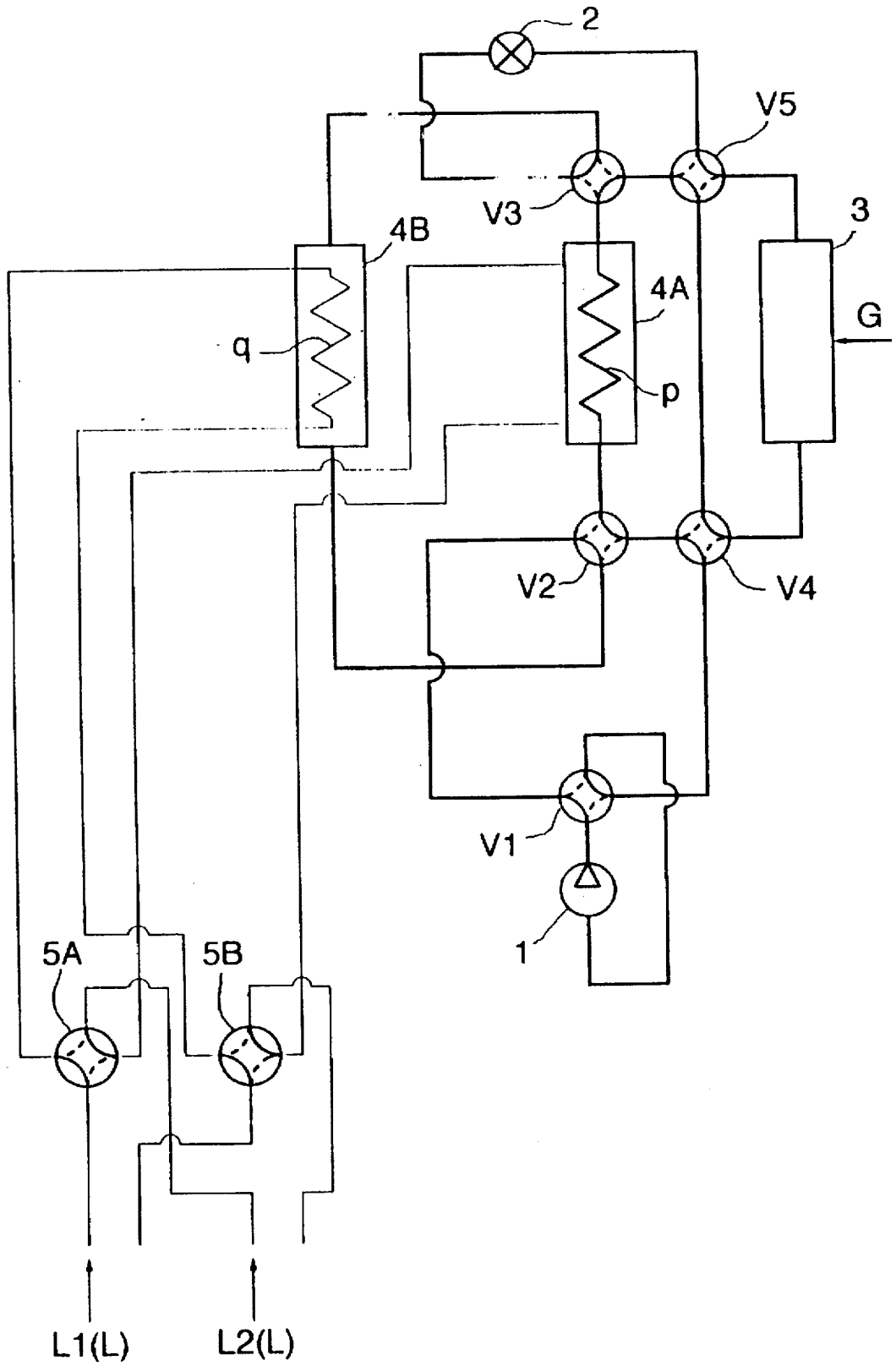
FIG. 1 is a circuit construction diagram of a heat pump apparatus relating to one preferred embodiment of the present invention.

In FIG. 1, numeral 1 denotes a compressor for circulating cooling medium, numeral 2 denotes an expander means such as an expansion valve, a capillary tube or the like, numeral 3 denotes a gas heat exchanger for effecting heat exchange between the cooling medium and gas G, mark 4A denotes a liquid evaporator heat exchanger for affecting heat exchange between the cooling medium and liquid L (L1 or L2), and a mark 4B denotes a liquid condenser heat exchanger for affecting heat exchange between the cooling medium and the liquid L (L1 or L2), respectively.

The liquid evaporator heat exchanger 4A includes an inner tube passage (p) so that the cooling medium is caused to flow inside the tube passage while heat-exchanged liquid L is caused to flow outside the passage whereby heat exchange takes place between the cooling medium and the liquid L through a wall of the tube. Reversely, the liquid condenser heat exchanger 4B includes an inner tube (q) so that the cooling medium is caused to flow outside the tube passage while heat-exchanged liquid L is caused to flow inside the passage whereby heat exchange takes place between the cooling medium and the liquid L through a wall of the tube.

Figure 10:
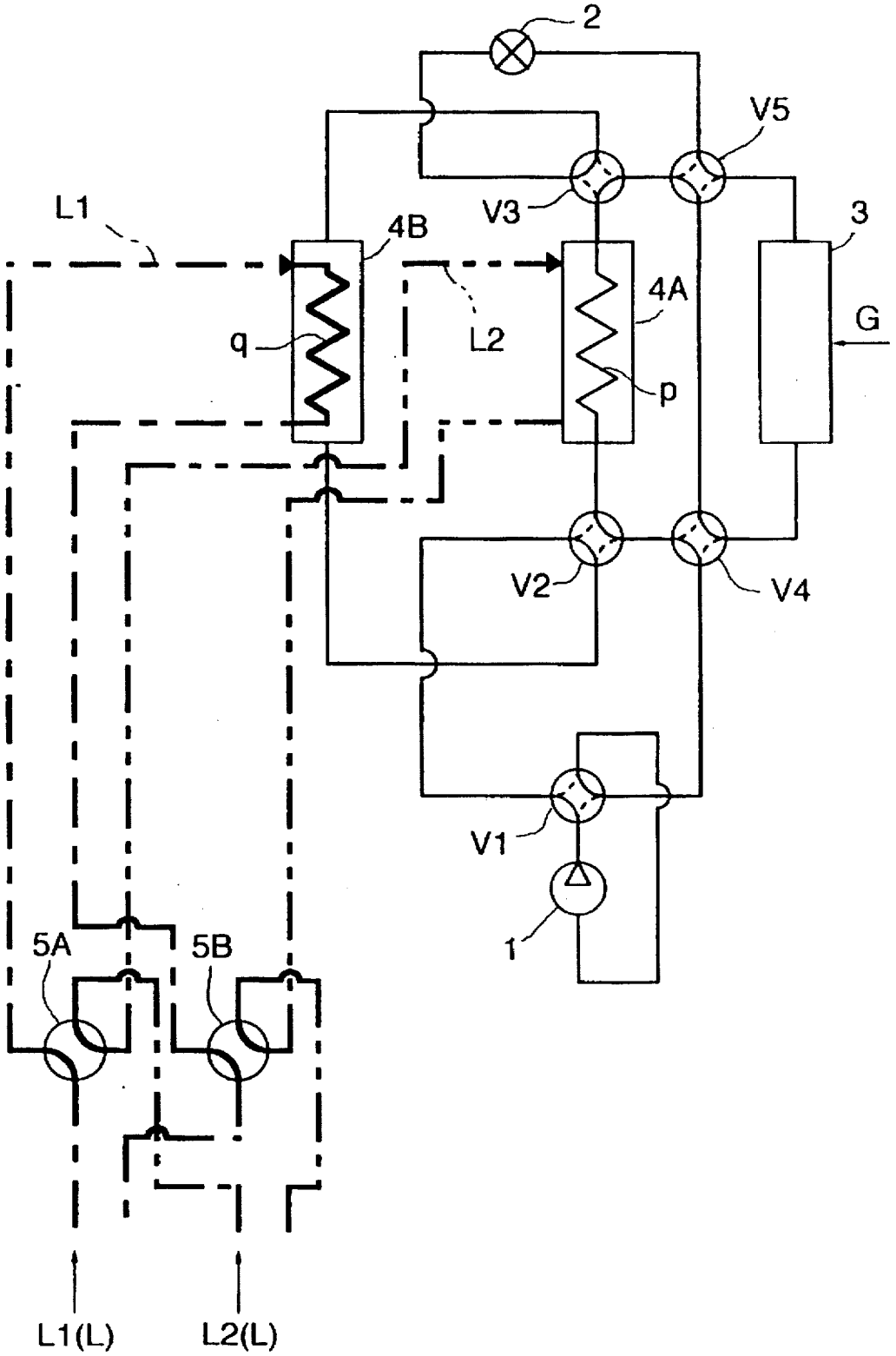
FIG. 10 is a circuit diagram illustrating flow of liquid in a first liquid feed mode.
Figure 11:
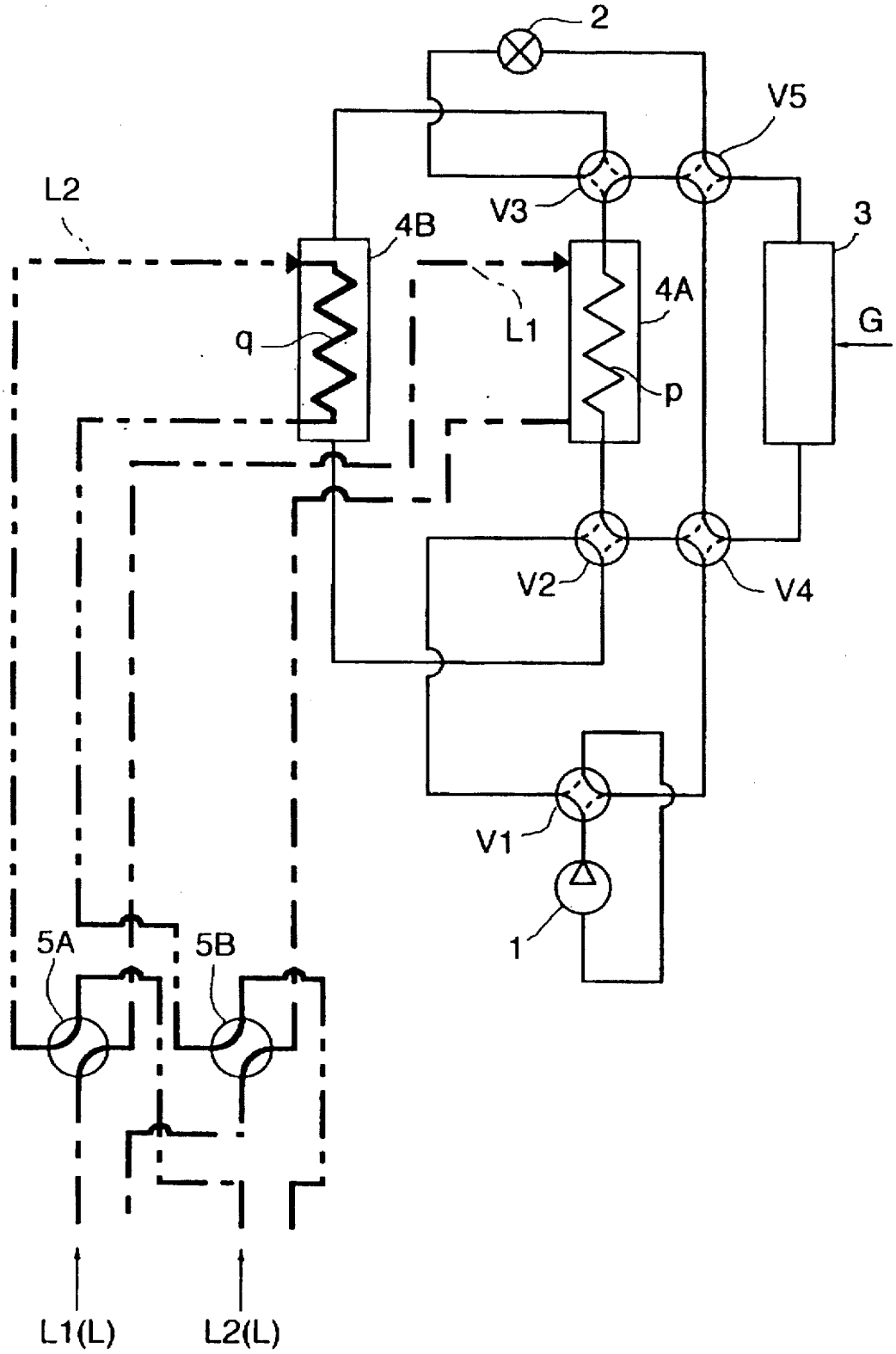
FIG. 11 is a circuit diagram illustrating flow of liquid in a second liquid feed mode.

Reference marks 5A, 5B respectively denote four-way liquid switch valves adapted for switching over the routes of the liquids L1, L2. With switching of these four-way valves 5A, 5B, there are selectively provided a first liquid feed mode illustrated in FIG. 10 in which the liquid L1 (denoted by an alternate long and short dash line in the figure) is fed to the liquid condenser heat exchanger 4B and also the liquid L2 (denoted by an alternate long and two short dashes line) is fed to the liquid evaporator heat exchanger 4A and a second liquid feed mode illustrated in FIG. 11 in which reversely of the first mode, the liquid L1 is fed to the liquid evaporator heat exchanger 4A and the liquid L2 is fed to the liquid condenser heat exchanger 4B.

In the circuit of the cooling medium, reference marks V1 through V5 respectively denote four-way switch valves for cooling medium adapted for switching over the circulation routes of the cooling medium. In operation, with switching of these four-way switch valves V1 through V5, there are selectively provided first through eighth circulation modes to be described next. Note that the circulation routes of the cooling medium are denoted with bold solid arrows in FIGS. 2 through 9.

First circulation mode

Figure 2:
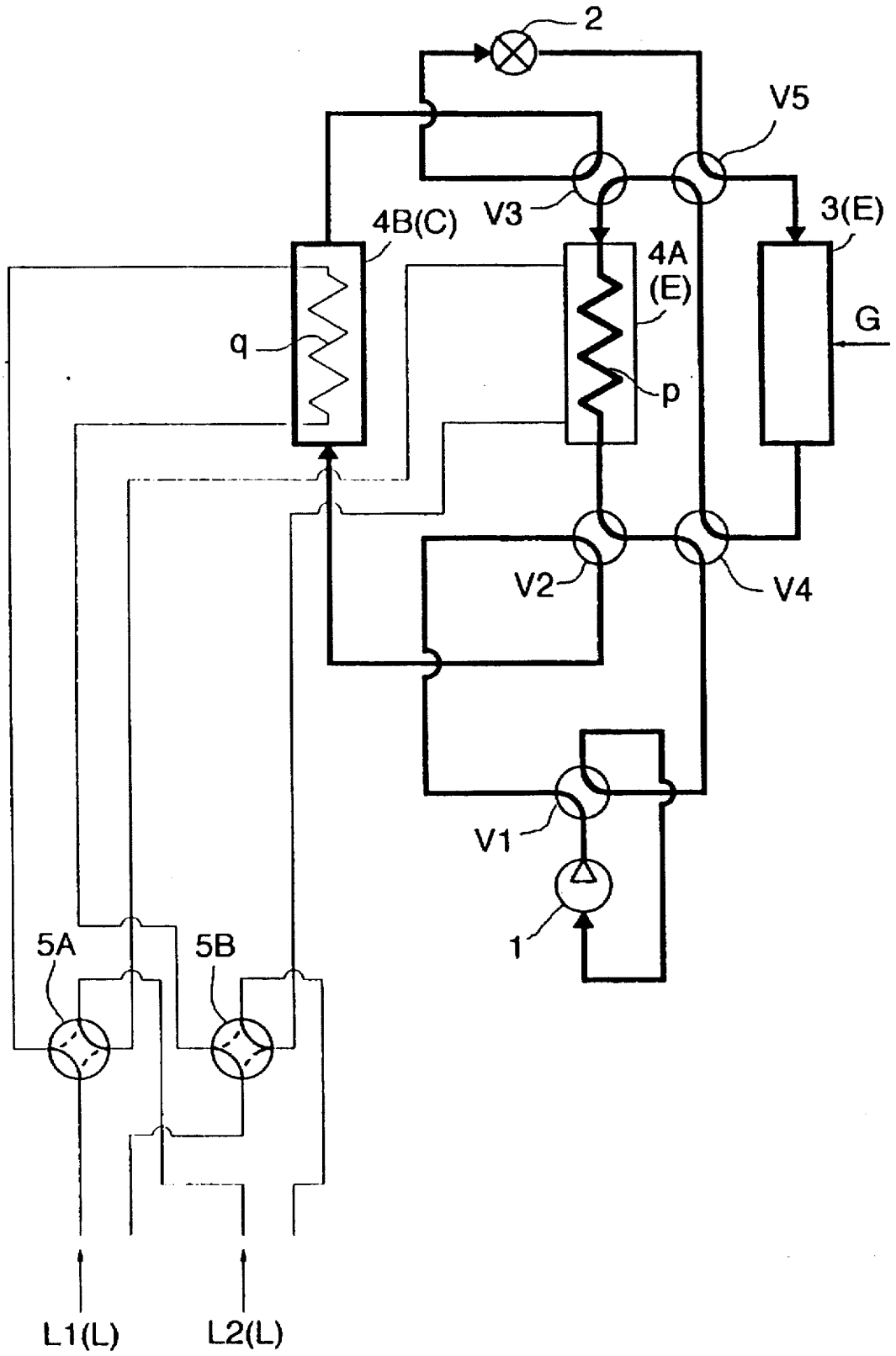
FIG. 2 is a circuit diagram illustrating circulation of cooling medium in a first circulation mode.

In this mode, as illustrated in FIG. 2, the condensation cooling medium (cooling medium in the form of high-pressure dry vapor) discharged from the compressor 1 is circulated to the liquid condenser heat exchanger 4B to cause this exchanger 4B to act as a condenser C. Further, the evaporation cooling medium (cooling medium in the form of low-pressure wet vapor) from the expander means 2 is serially circulated to the gas heat exchanger 3 and then to the liquid evaporator heat exchanger 4A to cause these exchangers 3 and 4B to act as evaporators E.

Second circulation mode

Figure 3:
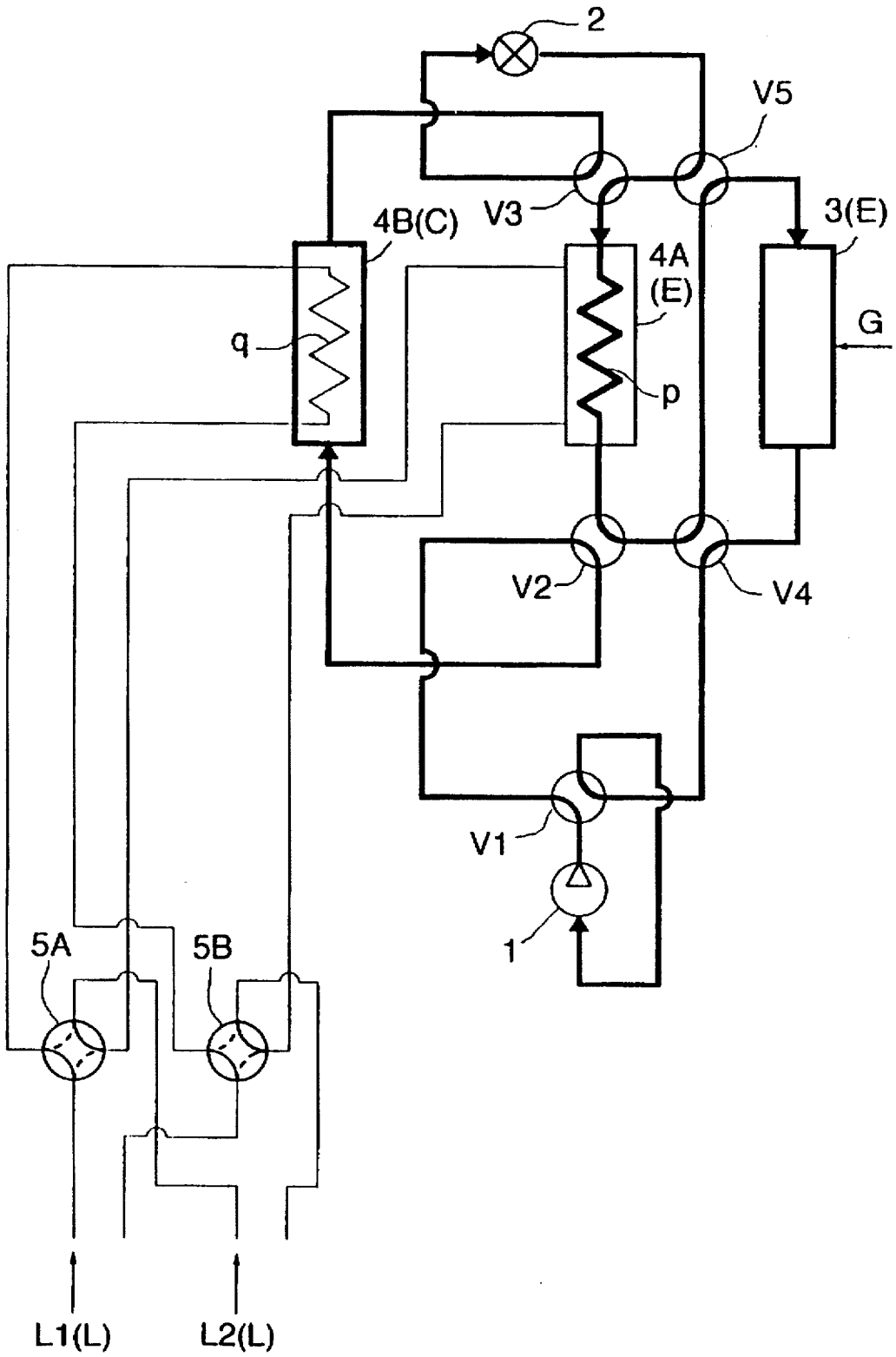
FIG. 3 is a circuit diagram illustrating circulation of cooling medium in a second circulation mode.

In this mode, as illustrated in FIG. 3, the condensation cooling medium discharged from the compressor 1 is circulated to the liquid condenser heat exchanger 4B to cause this exchanger 4B to act as a condenser C. Further, reversely from the first circulation mode described supra, the evaporation cooling medium from the expander means 2 is serially circulated first to the liquid evaporator heat exchanger 4A and then to the gas heat exchanger 3 to cause these exchangers 4A and 3 to act as evaporators E.

Third circulation mode

Figure 4:
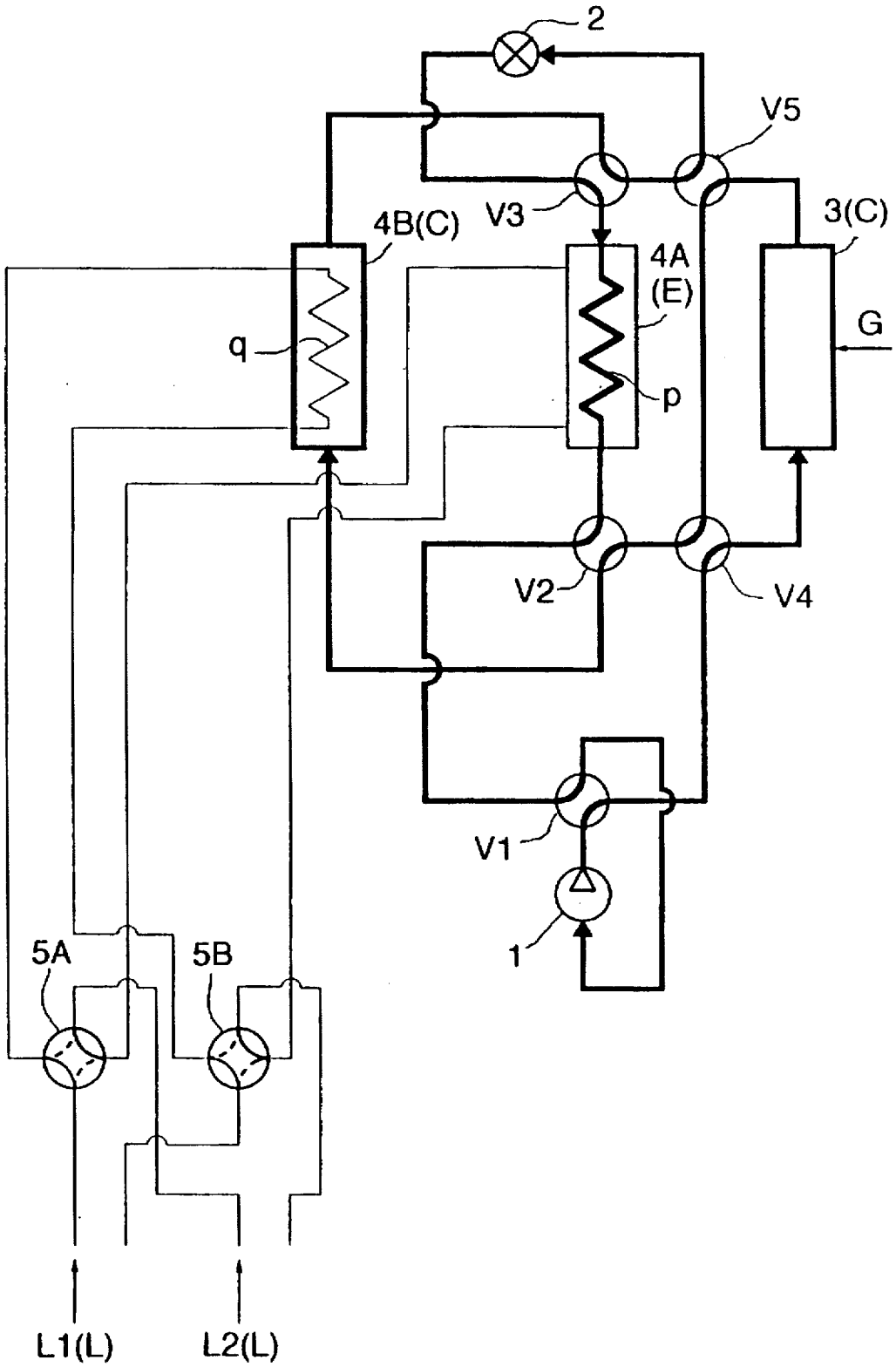
FIG. 4 is a circuit diagram illustrating circulation of cooling medium in a third circulation mode.

In this mode, as illustrated in FIG. 4, the condensation cooling medium discharged from the compressor 1 is serially circulated to the gas heat exchanger 3 and then to the liquid condenser heat exchanger 4B to cause these heat exchangers 3 and 4B to act as condensers C. Further, the evaporation cooling medium from the expander means 2 is circulated to the liquid evaporator heat exchanger 4A to cause this exchanger 4A to act as an evaporator E.

Fourth circulation mode

Figure 5:
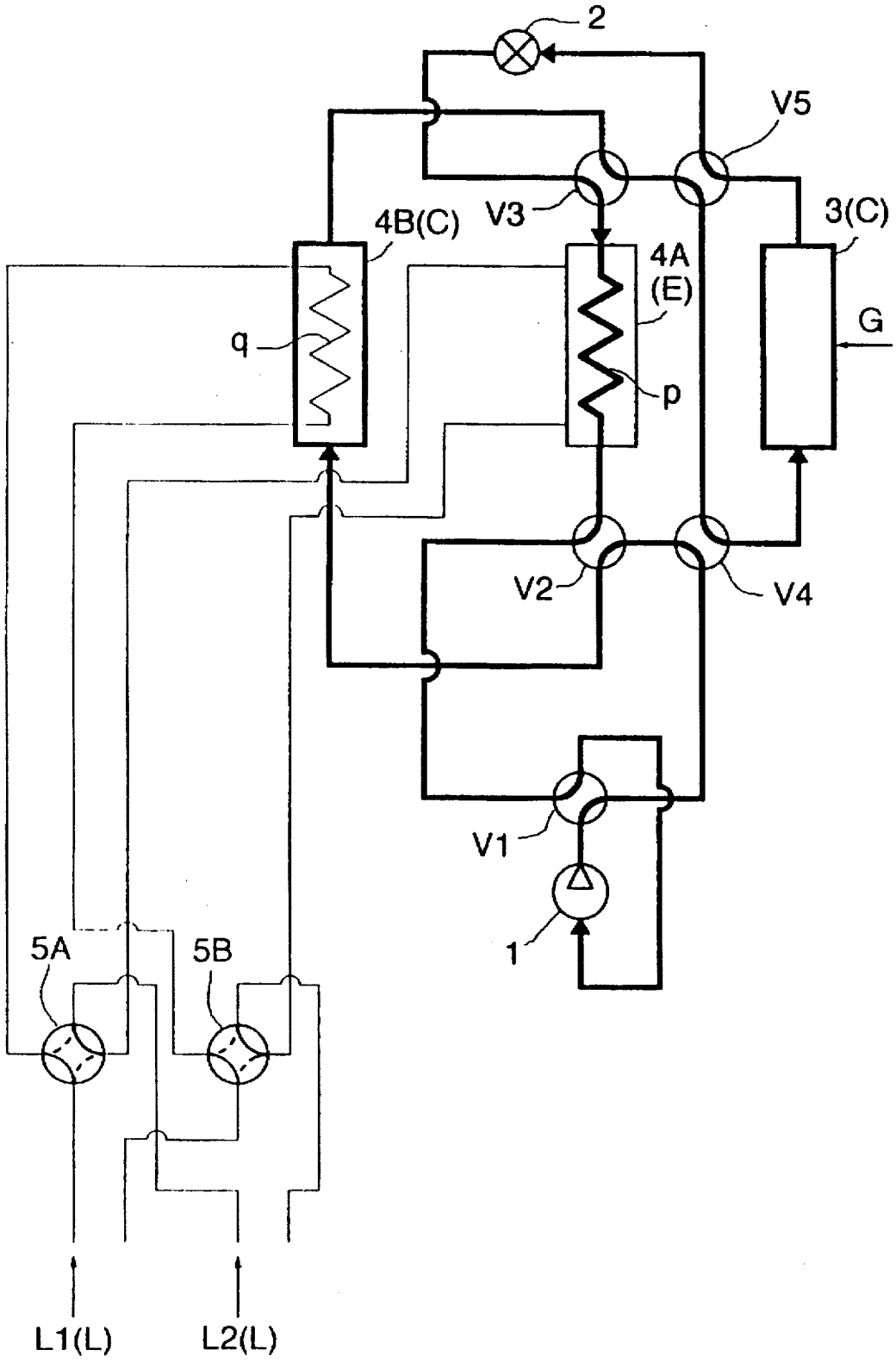
FIG. 5 is a circuit diagram illustrating circulation of cooling medium in a fourth circulation mode.

In this mode, as illustrated in FIG. 5, reversely of the third circulation mode described above, the condensation cooling medium discharged from the compressor 1 is serially circulated first to the liquid condenser heat exchanger 4B and then to the heat exchanger 3 to cause these heat exchangers 4B and 3 to act as condensers C. Further, the evaporation cooling medium from the expander means 2 is circulated to the liquid evaporator heat exchanger 4A to cause this exchanger 4A to act as an evaporator E.

Fifth circulation mode

Figure 6:
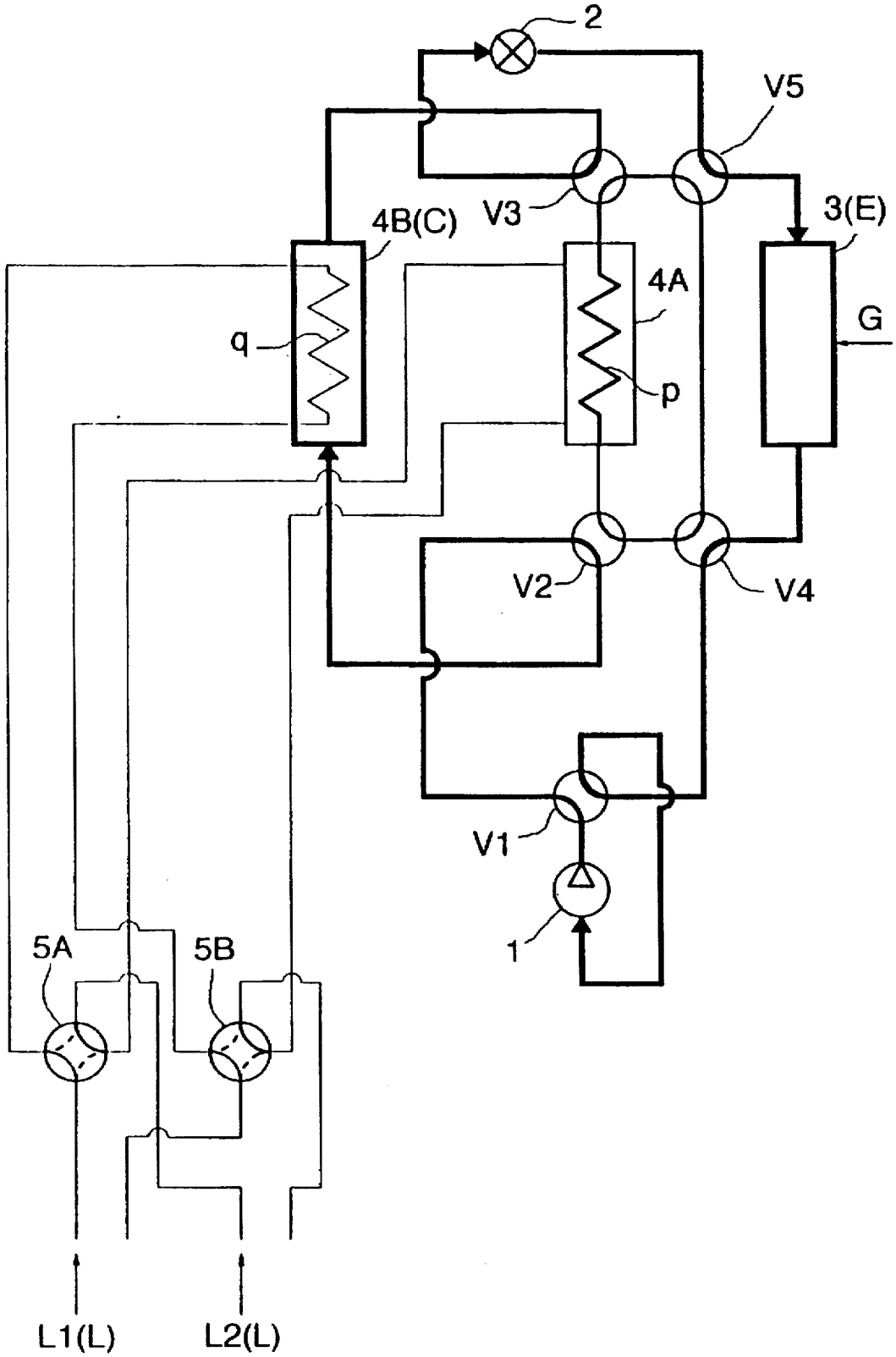
FIG. 6 is a circuit diagram illustrating circulation of cooling medium in a fifth circulation mode.

In this mode, as illustrated in FIG. 6, the condensation cooling medium discharged from the compressor 1 is circulated to the liquid condenser heat exchanger 4B to cause this exchanger 4B to act as a condenser C. Further, the evaporation cooling medium from the expander means 2 is circulated only to the gas heat exchanger 3 while the medium is prevented from being circulated to the liquid evaporator heat exchanger 4A, so as to cause the gas heat exchanger 3 alone to act as an evaporator E.

Sixth circulation mode

Figure 7:
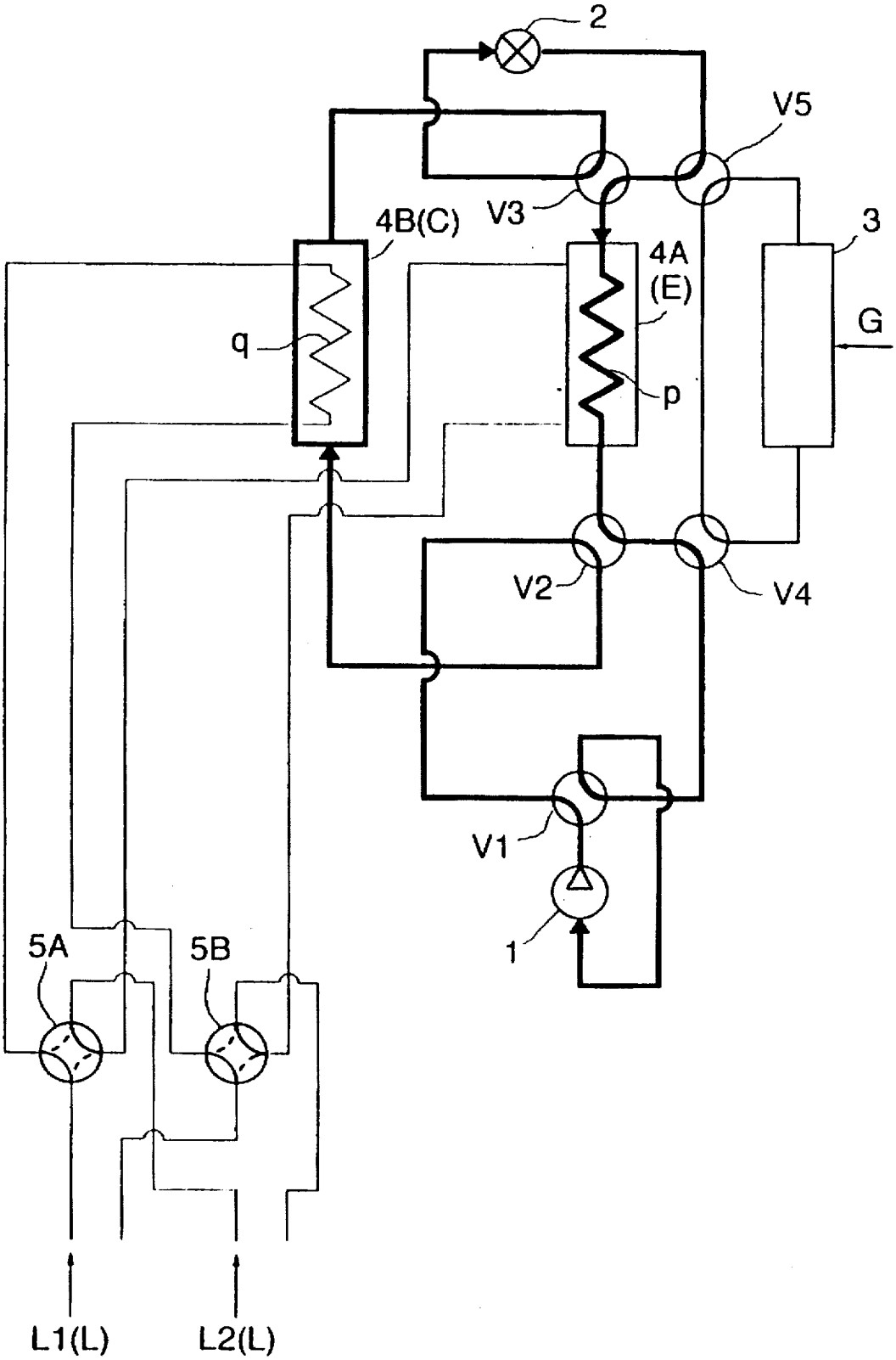
FIG. 7 is a circuit diagram illustrating circulation of cooling medium in a sixth circulation mode.

In this mode, as illustrated in FIG. 7, the condensation cooling medium discharged from the compressor 1 is circulated to the liquid condenser heat exchanger 4B to cause this exchanger 4B to act as a condenser C. Further, reversely from the fifth circulation mode described supra, the evaporation cooling medium from the expander means 2 is circulated only to the liquid evaporator heat exchanger 4A while the medium is prevented from being circulated to the gas heat exchanger 3, so as to cause the liquid evaporator heat exchanger 4A alone to act as an evaporator E.

Seventh circulation mode

Figure 8:
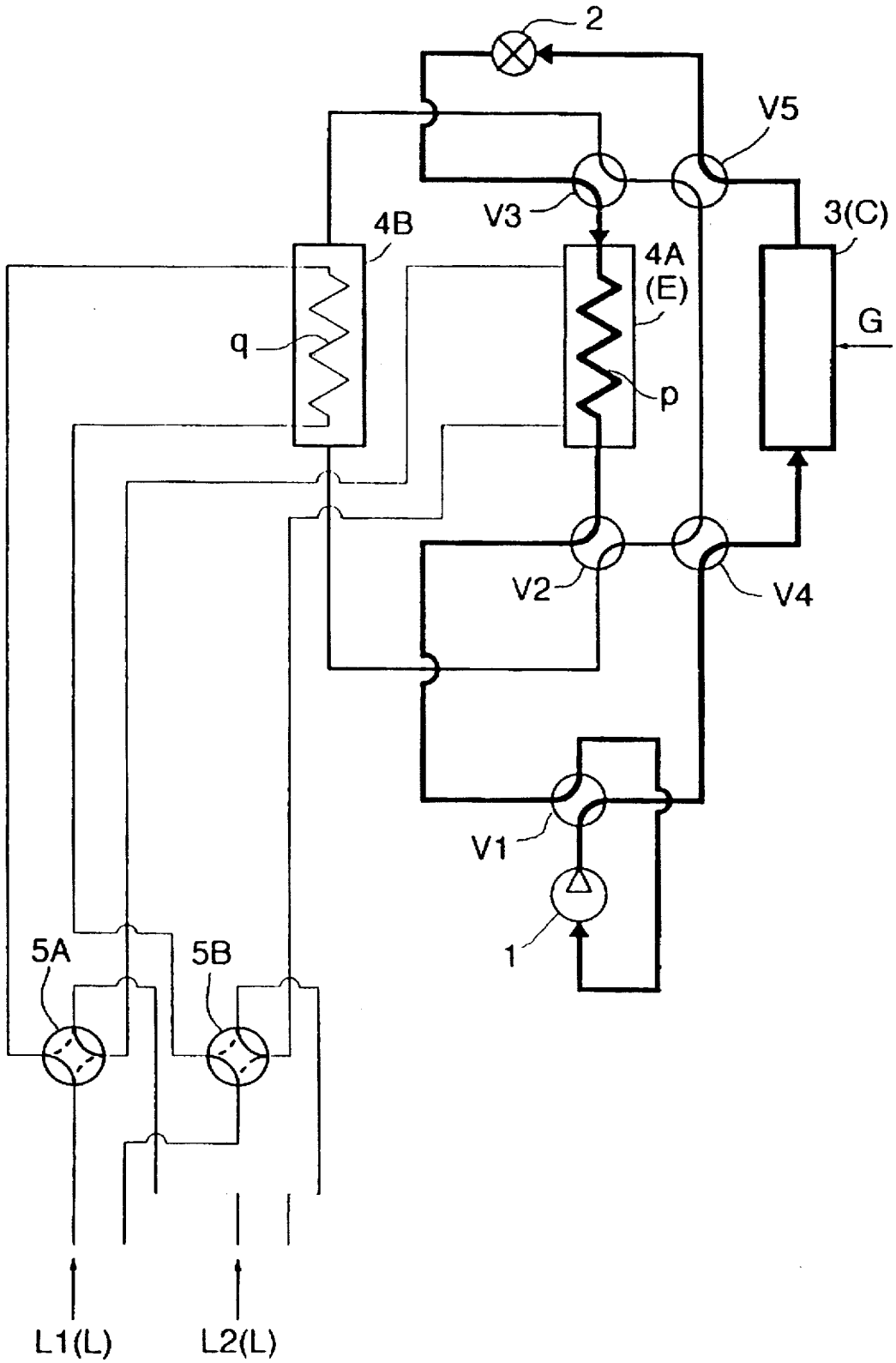
FIG. 8 is a circuit diagram illustrating circulation of cooling medium in a seventh circulation mode.

In this mode, as illustrated in FIG. 8, the condensation cooling medium discharged from the compressor 1 is circulated only to the gas heat exchanger 3 while the medium is prevented from being circulated to the liquid condenser heat exchanger 4B, so as to cause the gas heat exchanger 3 alone to act as a condenser C. Further, the evaporation cooling medium from the expander means 2 is circulated to the liquid evaporator heat exchanger 4A to cause this exchanger 4A to act as an evaporator E.

Eighth circulation mode

Figure 9:
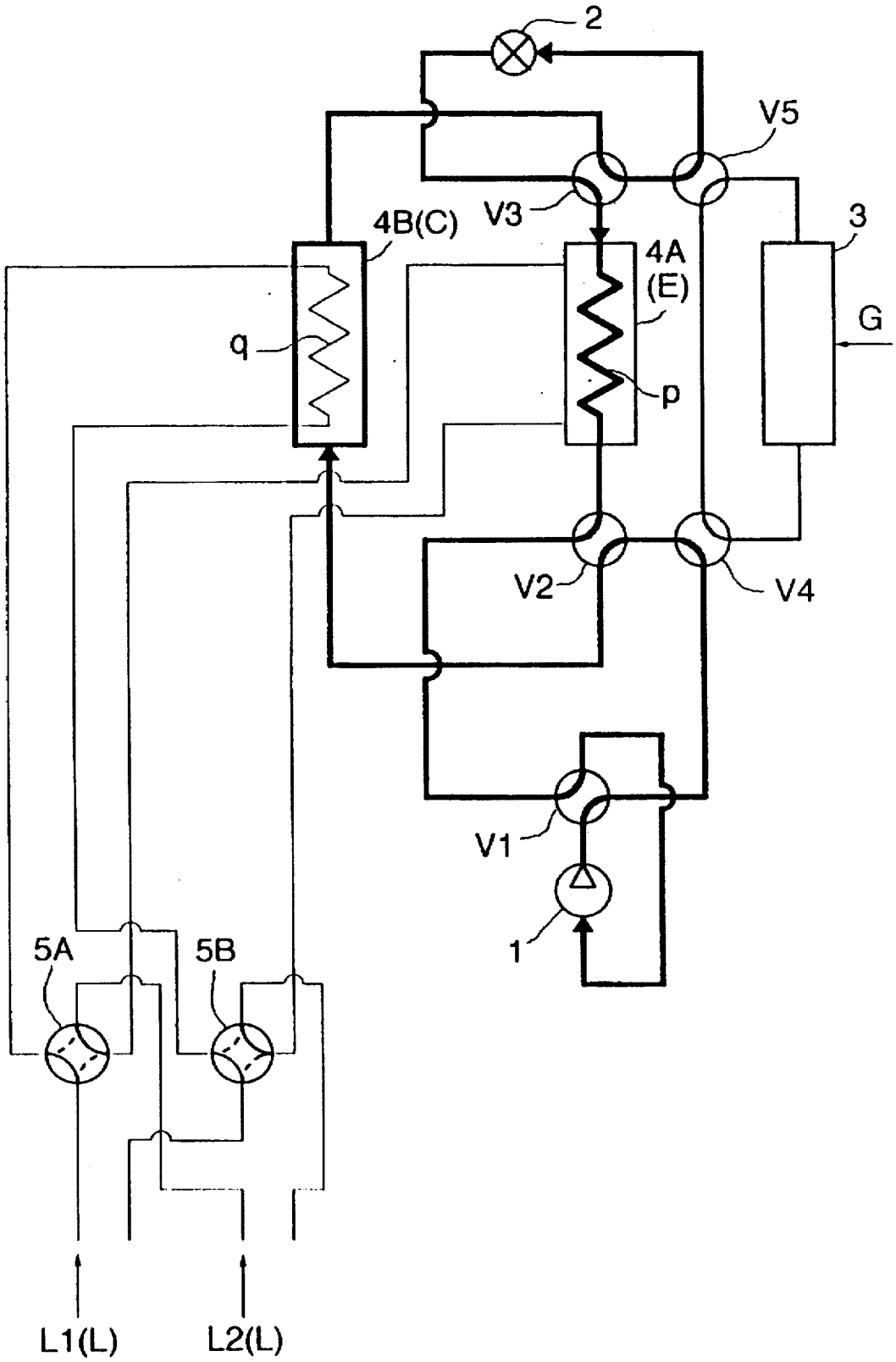
FIG. 9 is a circuit diagram illustrating circulation of cooling medium in an eighth circulation mode.

In this mode, as illustrated in FIG. 9, reversely of the seventh circulation mode described above, the condensation cooling medium discharged from the compressor 1 is circulated only to the liquid condenser heat exchanger 4B while the medium is prevented from being circulated to the gas heat exchanger 3, so as to cause the liquid condense heat exchanger 4B alone to act as a condenser C. Further, the evaporation cooling medium from the expander means 2 is circulated to the liquid evaporator heat exchanger 4A to cause this exchanger 4A to act as an evaporator E.

Next, some specific use modes of the heat pump apparatus having the above-described construction will be described.

First use mode

In this mode, the liquid L1 comprises load-side liquid to be heated or cooled (e.g. cooling water or brine for air cooling or heating). The liquid L2 comprises source-side liquid (e.g. water collected from a river or a well or exhaust water). The gas G comprises source-side gas (e.g. ambience air). Under these conditions, there is selectively effected a two-heat-collecting source mode in which the operation is effected under the first liquid feed mode (FIG. 10) in the first or second circulation mode (FIG. 2 or FIG. 3) or a two-heat-releasing source mode in which the operation is effected under the second liquid feed mode (FIG. 11) in the third or fourth circulation mode (FIG. 4 or FIG. 5).

More particularly, in the two-heat-collecting source mode, the liquid condenser heat exchanger 4B is used as a load-side heat exchanger and the load-side liquid L1 is heated by this liquid condenser heat exchanger 4B. Whereas, the gas heat exchanger 3 and the liquid evaporator heat exchanger 4A are used as source-side heat exchangers, so that these exchangers 3 and 4A are utilized for collecting, from both the gas G and the liquid L2 as the heat sources, an amount of heat needed for the heating by the liquid condenser heat exchanger 4B as the load-side heat exchanger.

Further, during this two-heat-collecting source mode, depending on e.g. the temperature or circulation condition of the gas G and the liquid L2 as heat collecting sources, the first circulation mode and the second circulation mode are automatically or manually switched over therebetween (i.e. switchover of the order of circulation of the evaporation cooling medium to the gas heat exchanger 3 and the liquid evaporator heat exchanger 4A as the source-side heat exchangers), based on detection of such condition. Alternatively, with using the same first liquid feed mode as the two-heat-collecting source mode, the fifth or sixth circulation mode (FIG. 6 or FIG. 7) (i.e. the operation mode in which only either one of the gas heat exchanger 3 and the liquid evaporator heat exchanger 4A as the source-side heat exchangers is operated for heat collection) will be selectively effected. In these manners, a very high coefficient of performance may be constantly achieved, regardless of change in the conditions such as temperature or flow amount of the gas G and the liquid L2 as the heat collecting sources.

On the other hand, in the two-heat-releasing source mode, the liquid evaporator heat exchanger 4A is used as a load-side heat exchanger and the load-side liquid L1 is cooled by this liquid evaporator heat exchanger 4A. Whereas, the gas heat exchanger 3 and the liquid condenser heat exchanger 4B are used as source-side heat exchangers, so that these exchangers 3 and 4B are utilized for releasing, to both the gas G and the liquid L2 as the heat releasing sources, the heat generated in association with the cooling by the liquid evaporator heat exchanger 4A as the load-side heat exchanger.

Further, similarly to the two-heat-collecting source mode described supra, during this two-heat-releasing source mode, depending on e.g. the temperature or circulation condition of the gas G and the liquid L2 as heat releasing sources, the third circulation mode and the fourth circulation mode are automatically or manually switched over therebetween (i.e. switchover of the order of circulation of the condensation cooling medium to the gas heat exchanger 3 and the liquid condenser heat exchanger 4B as the source-side heat exchangers), based on detection of such condition. Alternatively, with using the same second liquid feed mode as the two-heat-releasing source mode, the seventh or eighth circulation mode (FIG. 8 or FIG. 9) (i.e. the operation mode in which only either one of the gas heat exchanger 3 and the liquid condenser heat exchanger 4B as the source-side heat exchangers is operated for heat release) will be selectively effected. In these manners, a very high coefficient of performance may be constantly achieved, regardless of change in the conditions such as temperature or flow amount of the gas G and the liquid L2 as the heat collecting sources.

In addition, as to the two-heat-collecting source mode described hereinbefore, still further modes of operation are selectively available as described next. That is, with using the same first liquid feed mode as the two-heat-collecting source mode, the operation under the third circulation mode (or the fourth circulation mode) for the two-heat-releasing source mode may be effected. In this case, while the heat collecting function of the liquid evaporator heat exchanger 4A as the source-side heat exchanger and the heating function of the liquid condenser heat exchanger 4B as the load-side heat exchanger are maintained, the gas heat exchanger 3 as the other source-side heat exchanger may be operated as a condenser if necessary or appropriate. With this, it is possible to defrost the gas heat exchanger 3 which has been frosted during the heat collecting process in the two-heat-collecting source mode or to adjust or reduce the heating capacity of the load-side heat exchanger (i.e. the liquid condenser heat exchanger 4B) when the rate of revolution of the compressor is lowest.

Similarly, as to the two-heat-releasing source mode described hereinbefore, still further modes of operation are selectively available as described next. That is, with using the same second liquid feed mode as the two-heat-releasing source mode, the operation under the first circulation mode (or the second circulation mode) for the two-heat-collecting source mode may be effected. In this case, while the heat releasing function of the liquid condenser heat exchanger 4B as the source-side heat exchanger and the cooling function of the liquid evaporator heat exchanger 4A as the load-side heat exchanger are maintained, the gas heat exchanger 3 as the other source-side heat exchanger may be operated as an evaporator if necessary or appropriate. With this, it is possible to cool devices disposed peripherally of the gas heat exchanger 3 for protecting them against overheating or to adjust or reduce the heating capacity of the load-side heat exchanger (i.e. the liquid evaporator heat exchanger 4A) when the rate of revolution of the compressor is lowest.

Second use mode

In this mode, the liquid L1 comprises load-side liquid to be heated or cooled (e.g. cooling water or brine for air cooling or heating). The liquid L2 comprises source-side liquid (e.g. water collected from a river or a well or exhaust water). The gas G comprises load-side gas (e.g. the indoor air of a room to be cooled or heated) to be heated or cooled, in addition to the liquid L1. Under these conditions, there is selectively effected a two-cooling-load mode in which the operation is effected under the second liquid feed mode in the first or second circulation mode or a two-heating-load mode in which the operation is effected under the first liquid feed mode in the fourth circulation mode.

More particularly, in the two-cooling-load mode, the gas heat exchanger 3 and the liquid evaporator heat exchanger 4A are used as load-side heat exchangers and the load-side liquid L1 is cooled by the gas heat exchanger 3 and the liquid evaporator heat exchanger 4A. Whereas, the liquid condenser heat exchanger 4B is used as a source-side heat exchanger, so that this liquid condenser heat exchanger 3B is utilized for releasing, to the liquid L2 as the heat releasing source, the exhaust heat generated in association with the cooling by the gas heat exchanger 3 and the liquid evaporator heat exchanger 4A.

Further, during this two-cooling-load mode, depending on e.g. the temperature condition of the gas G and the liquid L1 as loads, the first circulation mode and the second circulation mode are automatically or manually switched over therebetween (i.e. switchover of the order of circulation of the evaporation cooling medium to the gas heat exchanger 3 and the liquid evaporator heat exchanger 4A as the load-side heat exchangers), based on detection of such condition. Alternatively, when the cooling of either one of the load-side gas G and the load-side liquid L1 becomes unnecessary, with using the same second liquid feed mode as the two-cooling-load mode, the fifth or sixth circulation mode (i.e. the operation mode in which only either one of the gas heat exchanger 3 and the liquid evaporator heat exchanger 4A as the load-side heat exchangers is operated for cooling) will be selectively effected. In these manners, a very high coefficient of performance may be constantly achieved, regardless of change in the conditions such as temperature of the load-side gas G and the load-side liquid L1.

On the other hand, in the two-heating-load mode, the gas heat exchanger 3 and the liquid condenser heat exchanger 4B are used as load-side heat exchangers, so that these exchangers 3 and 4B heat the load-side gas G and the load-side liquid L1. Whereas, the liquid evaporator heat exchanger 4A is used as a source-side heat exchanger, so that this heat exchanger 4A is utilized for collecting, from the liquid L2 as the heat collecting source, heat needed for the heating by the gas heat exchanger 3 and the liquid condenser heat exchanger 4B as the load-side heat exchangers.

Further, similarly to the two-cooling-load mode described supra, during this two-heating-load mode, depending on e.g. the temperature condition of the load-side gas G and the load-side liquid L1, the third circulation mode and the fourth circulation mode are automatically or manually switched over therebetween (i.e. switchover of the order of circulation of the condensation cooling medium to the gas heat exchanger 3 and the liquid condenser heat exchanger 4B as the load-side heat exchangers), based on detection of such condition. With this, a very high coefficient of performance may be achieved, regardless of change in e.g. the temperature condition of the load-side gas G and the load-side liquid L1. Further, when the heating of either one of the load gas G and the load liquid L1 becomes unnecessary, with using the same first liquid feed mode as the two-heating-load mode, the seventh or eighth circulation mode (i.e. the operation mode in which only either one of the gas heat exchanger 3 and the liquid condenser heat exchanger 4B as the load-side heat exchangers is operated for heating) will be selectively effected.

In addition, as to the two-cooling-load mode described hereinbefore, still further modes of operation are selectively available as described next. That is, with using the same second liquid feed mode as the two-cooling-load mode, the operation under the third circulation mode (or the fourth circulation mode) for the two-heating-load mode may be effected. In this case, while the heat releasing function of the liquid condenser heat exchanger 4B as the source-side heat exchanger and the cooling function of the liquid evaporator heat exchanger 4A as the load-side heat exchanger are maintained, the gas heat exchanger 3 as the other load-side heat exchanger may be operated as a condenser if necessary or appropriate for heating the load-side gas G. With this, it is possible to cope with switchover of the load-side gas G from the cooling load condition to the heating load condition, while the load-side liquid L1 is maintained as the cooling load.

Similarly, as to the two-heating-load mode described hereinbefore, still further modes of operation are selectively available as described next. That is, with using the same first liquid feed mode as the two-heating-load mode, the operation under the first circulation mode (or the second circulation mode) for the two-cooling-load mode may be effected. In this case, while the heat collecting function of the liquid evaporator heat exchanger 4A as the load-side heat exchanger and the heating function of the liquid condenser heat exchanger 4B as the source-side heat exchanger are maintained, the gas heat exchanger 3 as the other load-side heat exchanger may be operated as an evaporator if necessary or appropriate for cooling the load-side gas G. With this, it is possible to cope with switchover of the load-side gas G from the heating load condition to the cooling load condition, while the load-side liquid L1 is maintained as the heating load.

Third use mode

In this mode, the liquid L1 comprises load-side liquid to be heated (e.g. heating water or brine for air heating). The liquid L2 comprises load-side liquid to be cooled (e.g. cooling water or brine for air cooling). The gas G comprises source-side gas (e.g. outdoor ambience air). Under these conditions, there is selectively effected a heating/cooling mode primarily for heating in which the operation is effected under the first liquid feed mode in the first or second circulation mode or a further heating/cooling mode primarily for cooling in which the operation is effected under the first liquid feed mode in the third or fourth circulation mode.

More particularly, in these heating/cooling modes, the heating operation of the load-side liquid L1 by the liquid condenser heat exchanger 4B as the heating load-side heat exchanger and the cooling operation of the load-side liquid L2 by the liquid evaporator heat exchanger 4A are effected in parallel. On the other hand, the gas heat exchanger 3 is used as a source-side heat exchanger. In this respect, in the case of the primarily heating, heating/cooling mode, the gas heat exchanger 3 as the source-side heat exchanger is operated as an evaporator. That is, this gas heat exchanger collects, from the gas G as heat collecting source, an amount of heat which is deficient in the heat amount needed for the heating operation of the heating load-side heat exchanger (i.e. the liquid condenser heat exchanger 4B) after being partially compensated for by the collection of the exhaust heat generated in association with the cooling operation by the cooling load-side heat exchanger (i.e. the liquid evaporator heat exchanger 4A).

On the other hand, in the case of the primarily cooling, heating/cooling mode, the gas heat exchanger 3 as the source-side heat exchanger is operated as a condenser. That is, this gas heat exchanger 3 releases, to the gas G as the gas heat releasing source, an amount of heat which is left as surplus when a part of the amount of exhaust heat generated in association with the cooling by the cooling load-side heat exchanger (i.e. the liquid evaporator heat exchanger 4A) is collected and then deducted from the amount of heat needed for the heating of the heating load-side heat exchanger (i.e. the liquid condenser heat exchanger 4B).

Further, during the primarily heating, heating/cooling mode, depending on e.g. the temperature condition of the gas G and the liquid L1 as the heat collecting sources, the first circulation mode and the second circulation mode are appropriately switched over therebetween (i.e. switchover of the order of circulation of the evaporation cooling medium to the gas heat exchanger 3 as a source-side heat exchanger and the liquid evaporator heat exchanger 4A as a load-side heat exchanger), based on detection of such condition. With this, a very high coefficient of performance may be secured regardless of the change in e.g. the temperature condition of the gas G as the heat collecting source and the load-side liquid L2 to be cooled. Further, when the cooling of the load-side liquid L2 becomes unnecessary, with using the same first liquid feed mode as the primarily heating, heating/cooling mode, the fifth circulation mode (i.e. the operation mode in which only the gas heat exchanger 3 as the source-side heat exchanger is operated as an evaporator) will be selectively effected.

Similarly, during the primarily cooling, heating/cooling mode, depending on e.g. the temperature condition of the gas G and the liquid L1 as the heat releasing sources, the third circulation mode and the fourth circulation mode are appropriately switched over therebetween (i.e. switchover of the order of circulation of the condensation cooling medium to the gas heat exchanger 3 as a source-side heat exchanger and the liquid condenser heat exchanger 4B as a load-side heat exchanger), based on detection of such condition. With this, a very high coefficient of performance may be secured regardless of the change in e.g. the temperature condition of the gas G as the heat releasing source and the load-side liquid L1 to be heated. Further, when the heating of the load-side liquid L1 becomes unnecessary, with using the same first liquid feed mode as the primarily cooling, heating/cooling mode, the seventh circulation mode (i.e. the operation mode in which only the gas heat exchanger 3 as the source-side heat exchanger is operated as a condenser) will be selectively effected.

Incidentally, if the amount of heat needed for the heating by the heating load-side heat exchanger (i.e. the liquid condenser heat exchanger 4B) is balanced with the amount of exhaust heat generated in association with the cooling by the cooling load-side heat exchanger (i.e. the liquid evaporator heat exchanger 4A), as a switchover in the respective heating/cooling modes, in combination with the first liquid feed mode, either the sixth or eighth mode is selectively effected (i.e. while the supply of cooling medium to the gas heat exchanger 3 as the source-side heat exchanger is blocked, the liquid condenser heat exchanger 4B as the heating load-side heat exchanger is operated as a condenser and also the liquid evaporator heat exchanger 4A as the cooling load-side heat exchanger is operated as an evaporator).

In summary, in the above-described embodiments of the present invention, the four-way cooling-medium switch valves V1 through V5 constitute cooling-medium route switchover means for selectively providing the first through eighth circulation modes as switchover of the circulation routes of the cooling medium.

Further, the four-way cooling-medium switch valves V1 through V5 as the cooling-medium route switchover means described above and the four-way liquid switch valves 5A, 5B together constitute use mode switchover means for switching over use mode of the apparatus so as to switch over between the two-heat-collecting source mode and the two-heat-releasing source mode in the case of the use mode 1 and between the two-cooling-load mode and the two-heating-load mode in the case of the use mode 2, respectively.

Figure 12:
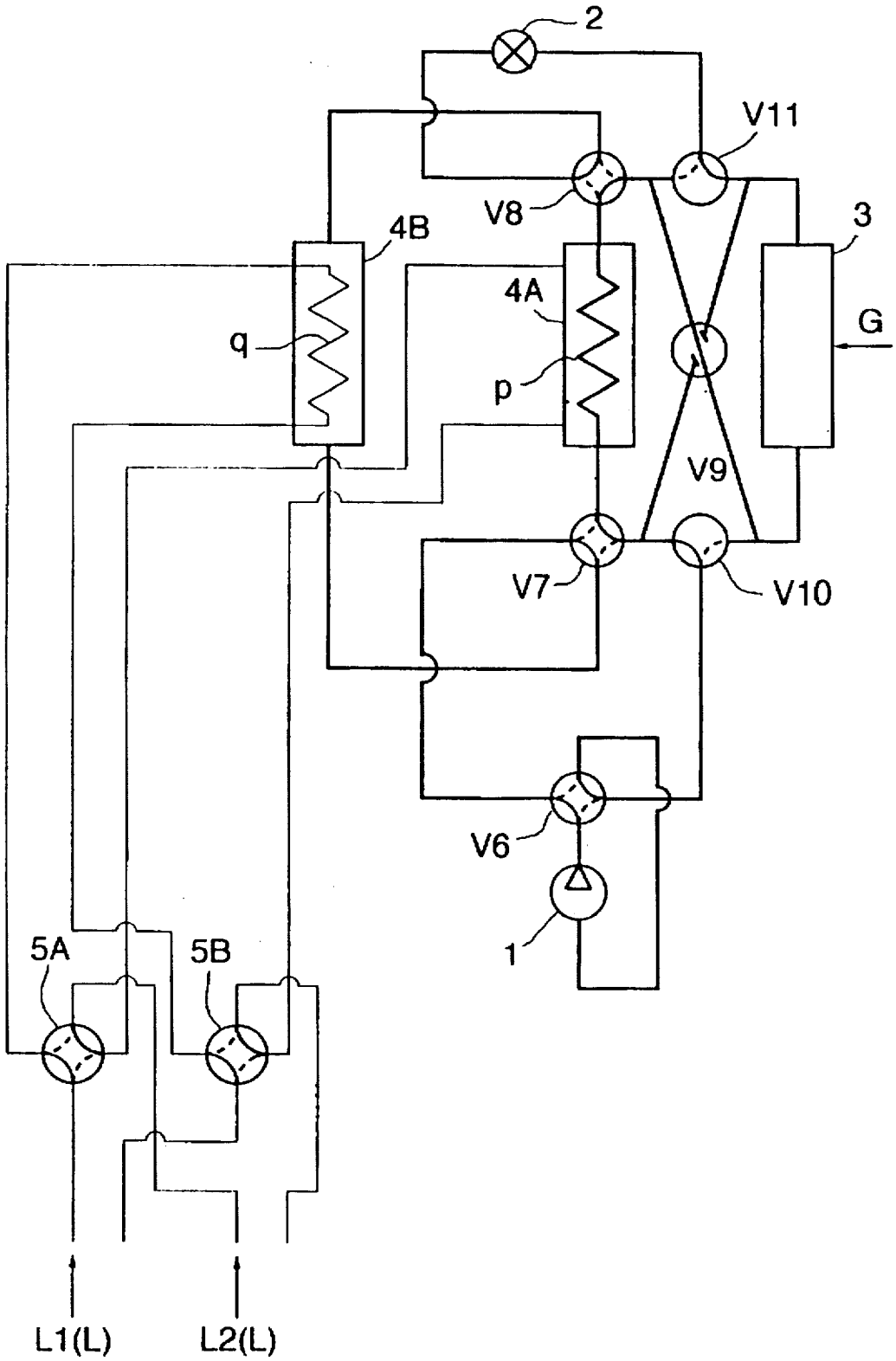
FIG. 12 is a circuit diagram relating to a further embodiment of the invention.

Other embodiments (1) In the foregoing embodiments, the cooling-medium route switchover means for selectively providing the variety of cooling medium circulation routes comprises the five units of four-way switch valves V1 through V5. Instead, as shown in FIG. 12, this means may be constituted from combination of four units of four-way switch valves V6 through V9 and two units of three-way switch valves V10, V11. Further, this switchover means may be constituted from other alternative and appropriate combinations of four-way switch valves, three-way switch valves or two-way switch valves or from a plurality of two-way switch valves alone.

(2) In the foregoing embodiments, the two units of four-way switch valves 5A, 5B together constitute the means for switching over the circulation of the heat-exchanged liquid L to be fed to the liquid evaporator heat exchanger or the liquid condenser heat exchanger. Instead, this means may be constituted in various manners by using three-way switch valves and/or two-way switch valves.

(3) The heat-exchanged liquid L to be fed to the liquid evaporator heat exchanger 4A or to the liquid condenser heat exchanger 4B is not limited to water or brine, but may be any other kind of liquid. Further, the gas G to be fed to the gas heat exchanger 3 is not limited to air, but may be any other kind of gas.

Figure 13:
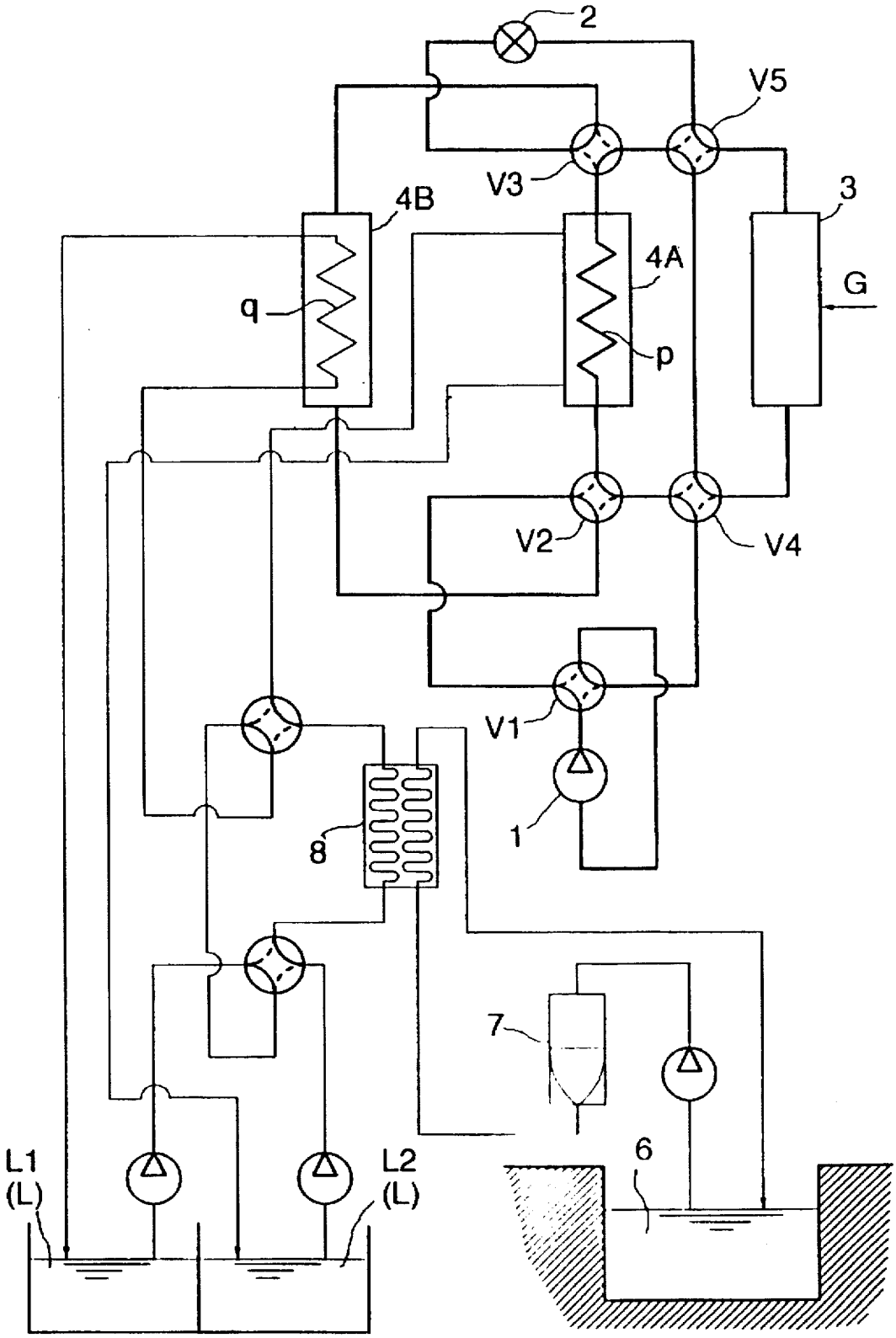
FIG. 13 is a circuit diagram illustrating flow of cooling medium in circulation relating to a still further embodiment of the present invention.

(4) In the use mode 3 in which the liquids L1, L2 are used as the load-side liquids to be heated and cooled respectively and the gas G is used as heat source, as illustrated in FIG. 13, it is possible to use e.g. river water, well water or waste water (waste water from a sewage system) 6 as a source-side liquid, in combination with the source-side gas G. More particularly, this source-side liquid is caused to pass an automatic strainer 7 having a filter function so that the source-side liquid is heat-exchanged with the liquid L2 or L1 through a heat exchanger (e.g. a plate type heat exchanger) 8. With this, in the primarily heating, heating/cooling load mode under the first liquid feed mode, when the cooling load becomes too small, it is possible to cope with this situation by using heat collected from the river water, well water or the waste water. Also, in the primarily cooling, heating/cooling mode under the second liquid feed mode, when the heating load becomes too small, it is possible to cope with this situation by using heat released from the river water, well water or waste water.

(5) In the foregoing embodiments, the liquid heat exchangers 4A, 4B respectively is used solely as an evaporator or a condenser. Instead, it is also conceivable to adapt each of these liquid heat exchangers 4A, 4B to be usable as either an evaporator or a condenser. Then, all of the three heat exchangers, i.e. the gas heat exchanger 3 and the liquid heat exchangers 4A, 4B may be used as evaporators or condensers. Or, two of the three heat exchangers may be used as evaporators and the other as a condenser. In these manners, the apparatus may provide a further variety of functions.

Also, the cooling-medium route switchover means will be constituted from five units of four-way switch valves V1 through V5 as in the foregoing embodiments. Alternatively, as illustrated in FIG. 12, this means may be constituted from four units of four-way switch valves V6 through V9 and two units of three-way switch valves V10, V11 or from a plurality of three-way or two-way valves alone.

Figure 14:
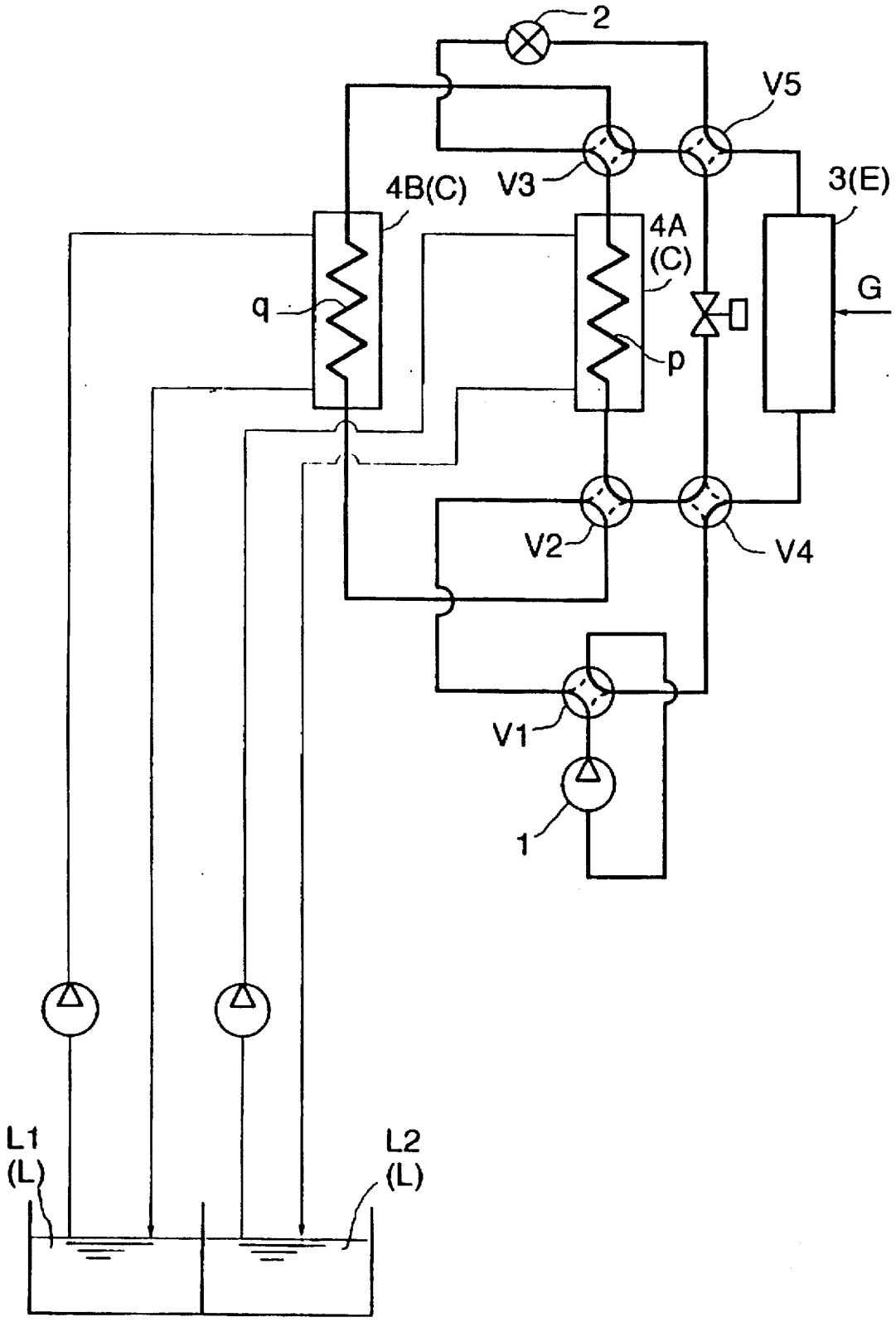
FIG. 14 is a circuit diagram illustrating flow of cooling medium in a circulation mode relating to a still further embodiment of the present invention.

(a) More particularly, as illustrated in FIG. 14 for example, both of the liquid heat exchangers 4A, 4B will be used as condensers C, whereas the gas heat exchanger 3 will be used as an evaporator E. Further, the liquid L1 comprises load-side liquid in the form of high-temperature water, whereas the liquid L2 comprises load-side liquid in the form of low-temperature water; and the gas G comprises source-side gas (source from which heat is to be collected).

As for a circulation mode for the above-described construction, condensation cooling medium discharged from the compressor 1 is circulated to the liquid heat exchanger 4B and then serially circulated to the other liquid heat exchanger 4A through a throttle valve, so that these heat exchangers 4A, 4B are used as condensers C. On the other hand, the evaporation cooling medium from the expander means 2 is caused to pass the gas heat exchanger 3, so that this gas heat exchanger 3 functions as an evaporator E.

Needless to say, in this case too, depending on e.g. the temperatures of the heat-exchanged mediums, the circulation orders of the condensation medium to the liquid heat exchangers 4A, 4B may be reversed so as to achieve a higher coefficient of performance.

Figure 15:
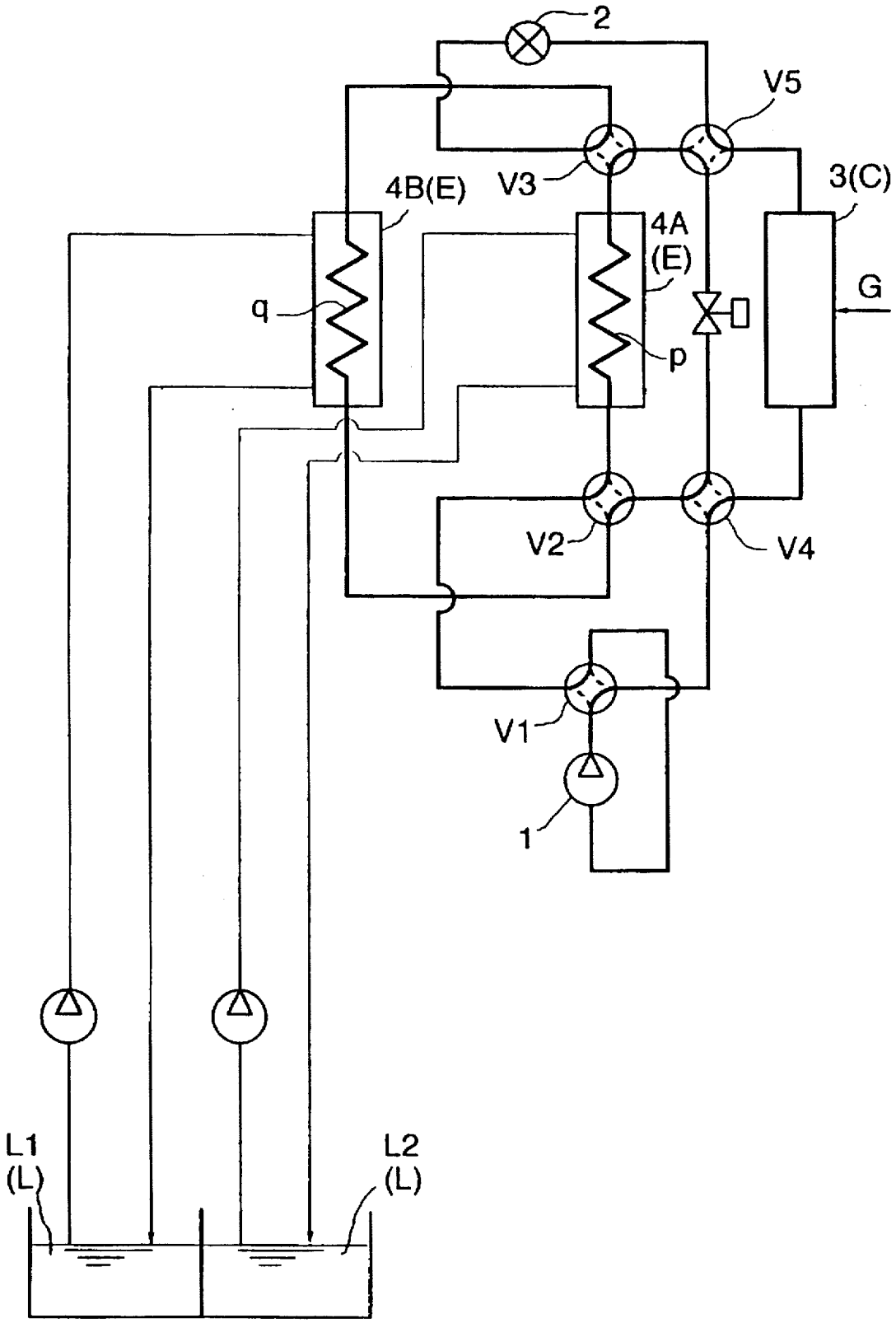
FIG. 15 is a circuit diagram illustrating flow of cooling medium in a further circulation mode relating to the embodiment of FIG. 14.

(b) A further alternate construction is conceivable as illustrated in FIG. 15. In this, both the liquid heat exchangers 4A, 4B are used as evaporators E and the gas heat exchanger 3 is used as a condenser C. Also, the liquid L1 comprises load-side liquid in the form of high-temperature water and the liquid L2 comprises load-side liquid in the form of low-temperature water, and the gas G comprises source-side gas (gas releasing source).

As to the circulation mode in the above construction, the condensation cooling medium discharged from the compressor 1 is circulated to the gas heat exchanger 8; whereas, the evaporation cooling medium from the expander means 2 is circulated to the liquid heat exchanger 4B and then serially circulated to the other liquid heat exchanger 4A through a throttle valve, so that these liquid heat exchangers 4A, 4B both are used as evaporators E.

In this case too, depending on e.g. the temperatures of the heat-exchanged mediums, the circulation order of the condensation cooling medium to the liquid heat exchangers 4A, 4B may be reversed so as to achieve a higher coefficient of performance.

Furthermore, it is also conceivable to use both the liquid heat exchanger 4A and the gas heat exchanger 8 as condensers and the other liquid heat exchanger 4B as an evaporator, or to use both the liquid heat exchanger 4B and the gas heat exchanger 3 as evaporators and the liquid heat exchanger 4A as a condenser. And, the circulation order thereof may be reversed, depending on the conditions of the heat-exchanged mediums.

(6) Although FIGS. 1 through 15 show the circuit diagrams of the apparatus constructions, circulation modes and liquid feed modes, it is understood that these constructions and modes are just exemplary, not limiting the scope of the invention. That is, as long as the cooling medium routes, liquid feed circulations disclosed in the respective embodiments are maintained, the arrangements of the gas heat exchanger and the liquid heat exchangers may be freely varied from those illustrated in the figures.

Namely, the invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A heat pump apparatus comprising:

a compressor;

expander means;

at least three heat exchangers; and cooling-medium route switchover means for switching over cooling-medium route to the heat exchangers so as to selectively provide a two-evaporator operation mode in which two of the heat exchangers are used as evaporators and the other heat exchanger is used as a condenser and a two-condenser operation mode in which two of the heat exchangers are used as condensers and the other heat exchanger is used as an evaporator;

wherein said two heat exchangers used as evaporators in said two-evaporator operation mode or as condensers in said two-condenser operation mode are serially connected with each other; and said cooling-medium route switchover means reversely switches over the order of circulation of the cooling-medium through said two evaporators in said two-evaporator operation mode or through said two condensers in said two-condenser operation mode, so as to enhance the coefficient of performance.

2. A heat pump apparatus as claimed in claim 1, wherein said cooling-medium route switchover means allows selection of said two heat exchangers to be used as evaporators in said two-evaporator operation mode and selection of the two heat exchangers to be used as condensers in said two-condenser operation mode.

3. A heat pump apparatus comprising:

a compressor;

expander means;

at least three heat exchangers; and cooling-medium route switchover means for switching over cooling-medium route to the heat exchangers so as to selectively provide a two-evaporator operation mode in which two of the heat exchangers are used as evaporators and the other heat exchanger is used as a condenser and a two-condenser operation mode in which two of the heat exchangers are used as condensers and the other heat exchanger is used as an evaporator, wherein said two heat exchangers used as evaporators in said two-evaporator operation mode or as condensers in said two-condenser operation mode are serially connected with each other, said cooling-medium route switchover means allows selection of said two heat exchangers to be used as evaporators in said two-evaporator operation mode and selection of the two heat exchangers to be used as condensers in said two-condenser operation mode, said three heat exchangers include a gas heat exchanger for exchanging heat between the cooling medium and gas, a liquid evaporator heat exchanger for exchanging heat between the cooling medium flowing inside a tube and liquid flowing outside the tube through a wall of the tube, and a liquid condenser heat exchanger for exchanging heat between liquid flowing inside a tube and the cooling medium flowing outside the tube through a wall of the tube, and said cooling-medium route switchover means selectively provide a first circulation mode for using the gas heat exchanger and the liquid evaporator heat exchanger as evaporators by causing the evaporation cooling medium to circulate through the gas heat exchanger and then the liquid evaporator heat exchanger in series, a second circulation mode for using the liquid evaporator heat exchanger and the gas heat exchanger as evaporators by causing the evaporation cooling medium to circulate through the liquid evaporator heat exchanger and then the gas heat exchanger in series, a third circulation mode for using the gas heat exchanger and the liquid condenser heat exchanger as condensers by causing the condensation cooling medium to circulate through the gas heat exchanger and then the liquid condenser heat exchanger in series, and a fourth circulation mode for using the liquid condenser heat exchanger and the gas heat exchanger as condensers by causing the condensation cooling medium to circulate through the liquid condenser heat exchanger and then the gas heat exchanger in series.

4. A heat pump apparatus as claimed in claim 3, wherein in said first and second circulation modes, said cooling-medium route switchover means circulates the condensation cooling medium to the liquid condenser heat exchanger so as to cause this liquid condenser heat exchanger to act as the condenser; and in said third and fourth circulation mode, said cooling-medium route switchover means circulates the evaporation cooling medium to the liquid evaporator heat exchanger so as to cause this liquid evaporator heat exchanger to act as the evaporator.

5. A heat pump apparatus as claimed in claim 4, wherein the apparatus further comprises use mode switchover means for selectively providing a two-heat-collecting source mode for selectively effecting the first and second circulation modes by using the gas heat exchanger and the liquid evaporator heat exchanger as source-side heat exchangers and using the liquid condenser heat exchanger as a load-side heat exchanger and a two-heat-releasing source mode for selectively effecting the third and fourth circulation modes by using the gas heat exchanger and the liquid condenser heat exchanger as source-side heat exchangers and using the liquid evaporator heat exchanger as a load-side heat exchanger.

6. A heat pump apparatus as claimed in claim wherein in switching over from said two-heat-collecting source mode or said two-heat-releasing source mode, said cooling-medium route switchover means is capable of selectively providing a state in which the gas heat exchanger functions as a source-side heat exchanger functions as an evaporator and a further state in which the gas heat exchanger functions as a condenser, through switchover of the cooling-medium route without switching over the source-side heat exchanger and the load-side heat exchanger.

7. A heat pump apparatus as claimed in claim 4, wherein the apparatus further comprises use mode switchover means for selectively providing a two-cooling-load mode for selectively effecting the first and second circulation modes by using the gas heat exchanger and the liquid evaporator heat exchanger as load-side heat exchangers and using the liquid condenser heat exchanger as a source-side heat exchanger and a two-heating-load mode for selectively effecting the third and fourth circulation modes by using the gas heat exchanger and the liquid condenser heat exchanger as load-side heat exchangers and using the liquid evaporator heat exchanger as a source-side heat exchanger.

8. A heat pump apparatus as claimed in claim 7, wherein in switching over from the two-cooling-load mode or the two-heating-load mode, said cooling-medium route switchover means is capable of selectively providing a state in which the gas heat exchanger functions as an evaporator and a further state in which the gas heat exchanger functions as a condenser, through switchover of the cooling-medium route without changing the source-side heat exchanger and the load-side heat exchanger.

9. A heat pump apparatus as claimed in claim 4, wherein said first through fourth circulation modes are selectively effected by using the liquid evaporator heat exchanger and the liquid condenser heat exchanger as the load-side heat exchangers and using the gas heat exchanger as the source-side heat exchanger.

10. A heat pump apparatus as claimed in claim 3, wherein said cooling-medium route switchover means selectively provides, in addition to the first through fourth circulation modes, a fifth circulation mode in which the evaporation cooling medium is circulated only to the gas heat exchanger while being not circulated to the liquid evaporator heat exchanger, a sixth circulation mode in which the evaporation cooling medium is circulated only to the liquid evaporator heat exchanger while being not circulated to the gas heat exchanger, a seventh circulation mode in which the condensation cooling medium is circulated only to the gas exchanger while being not circulated to the liquid condenser heat exchanger, and an eighth circulation mode in which the condensation cooling medium is circulated only to the liquid condenser heat exchanger while being not circulated to the gas heat exchanger.

* * * * *